US006385781B1

(12) United States Patent
Rose et al.

(10) Patent No.: US 6,385,781 B1
(45) Date of Patent: May 14, 2002

(54) ADAPTIVE, ENERGY ABSORBING SHOULDER PAD MOUNTED HEAD CAGE

(76) Inventors: Carl Martin Rose, 6611 Cottonwood Knoll, West Bloomfield, MI (US) 48322; Elwyn R. Gooding, 2989 W. North Territorial Rd., Ann Arbor, MI (US) 48105

( * ) Notice: Subject to any disclaimer, the term of this patent is extended or adjusted under 35 U.S.C. 154(b) by 0 days.

(21) Appl. No.: 09/533,357

(22) Filed: Mar. 23, 2000

Related U.S. Application Data

(60) Provisional application No. 60/125,713, filed on Mar. 23, 1999, and provisional application No. 60/172,523, filed on Dec. 17, 1999.

(51) Int. Cl.[7] ..... A63B 71/10

(52) U.S. Cl. ..... 2/425; 2/421; 2/468; 2/DIG. 3

(58) Field of Search ..... 2/410, 425, 421, 2/DIG. 3, 468, 461

(56) References Cited

U.S. PATENT DOCUMENTS

| | | | | | |
|---|---|---|---|---|---|
| 1,163,247 | A | * | 12/1915 | McGrew | |
| 3,134,106 | A | * | 5/1964 | Shaffer et al. | |
| 3,671,974 | A | | 6/1972 | Sims | 2/3 R |
| 3,707,004 | A | | 12/1972 | Kapitan et al. | 2/2.5 |
| 3,818,509 | A | | 6/1974 | Romo et al. | 2/3 R |
| D233,635 | S | * | 11/1974 | Litsinger, Sr. | |
| 3,879,761 | A | * | 4/1975 | Bothwell | |
| 3,958,275 | A | | 5/1976 | Morgan et al. | 2/2.1 R |
| 3,978,525 | A | | 9/1976 | Bothwell | 2/424 |
| 4,219,193 | A | * | 8/1980 | Newman | |
| 4,236,514 | A | | 12/1980 | Moretti | 128/201.23 |
| 4,605,000 | A | | 8/1986 | Anguita | 128/201.25 |
| 4,613,993 | A | | 9/1986 | Steele et al. | 2/411 |
| 4,825,476 | A | | 5/1989 | Andrews | 2/421 |
| 4,982,451 | A | | 1/1991 | Graham | 2/410 |
| 4,999,855 | A | | 3/1991 | Brown | 2/421 |
| 5,029,341 | A | | 7/1991 | Wingo, Jr. | 2/2 |
| 5,123,408 | A | | 6/1992 | Gaines | 602/17 |
| 5,261,125 | A | | 11/1993 | Cartwright et al. | 2/421 |
| 5,295,271 | A | | 3/1994 | Butterfield et al. | 2/410 |
| 5,353,437 | A | | 10/1994 | Field et al. | 2/2 |
| 5,390,367 | A | | 2/1995 | Rush, III | 2/2 |
| 5,444,870 | A | | 8/1995 | Pinsen | 2/2 |
| 5,517,699 | A | | 5/1996 | Abraham, II | 2/425 |
| 5,553,330 | A | | 9/1996 | Carveth | 2/425 |
| 5,715,541 | A | | 2/1998 | Landau | 2/425 |
| 5,794,270 | A | | 8/1998 | Howat | 2/410 |
| 6,052,835 | A | * | 4/2000 | O'Shea | |

FOREIGN PATENT DOCUMENTS

| | | | |
|---|---|---|---|
| CA | 2039185 | | 9/1992 |
| DE | 2825145 | * | 12/1979 |
| EP | 0 108 694 A1 | | 5/1984 |
| EP | 0 108 694 B1 | | 5/1984 |
| EP | 0 108 694 B2 | | 5/1984 |
| GB | 2 240 255 A | | 7/1991 |
| JP | 6-166906 | * | 6/1994 |

* cited by examiner

*Primary Examiner*—Rodney M. Lindsey
(74) *Attorney, Agent, or Firm*—Gifford, Krass, Groh, Sprinkle, Anderson & Citkowski, P.C.

(57) ABSTRACT

A high energy shock absorbing and dissipating device designed to be mounted on existing shoulder pads for football, hockey, dirt bike riders, etc. The head of the wearer is in a spaced relation to the inside surfaces. It consists of a crown structure and a lower support structure with vertical shock absorbing springs in between. An energy dissipating foam annular band is in a plane at the forehead level to attenuate the forces from whiplash-type movements. The possibility of the wearer receiving a concussion is virtually eliminated and will have the maximum of protection against devastating spinal cord injuries.

13 Claims, 35 Drawing Sheets

ADAPTIVE, ENERGY ABSORBING SHOULDER PAD MOUNTED HEAD CAGE

CROSS-REFERENCE TO RELATED APPLICATIONS

This application claims the benefit of U.S. Provisional Applications having Ser. No. 60/125,713 filed Mar. 23, 1999 and Ser. No. 60/172,523 filed Dec. 17, 1999.

BACKGROUND OF THE INVENTION

1. Field of the Invention

The present invention relates to an adaptive, energy absorbing shoulder mounted head cage apparatus. More specifically, the invention relates to a structure that completely encircles the head and neck of the wearer but is in spaced relation and thereby permits normal movement of the head. Upon impact from any direction, and especially to the vertex (or top of the head), the apparatus transfers the kinetic energy of the impact through the structure and to the shoulder pad on which it is mounted.

2. Description of the Prior Art

Various devices have been proposed that protect a user's head from injury. For example, U.S. Pat. No. 3,707,004 issued in December 1972 to Kapitan et al., discloses a dome-like shock-resistant guard that rests on the shoulders of the wearer. U.S. Pat. No. 4,825,476 to Andrews, issued in May 1989 and discusses helmet having a bottom that is mounted on an annular track, the track is mounted on a shoulder pad. U.S. Pat. No. 4,999,855, that issued in March 1991 to Brown, is directed to a combination helmet and upper body protector. U.S. Pat. No. 5,295,271 to Butterfield, March 1994, in which an open cage head protector is supported by a shoulder pad. U.S. Pat. No. 5,353,437 to Field et al., issued in October 1994, discloses one helmet freely rotatable within a second outer helmet. The second outer helmet is attached to a shoulder pad. U.S. Pat. No. 5,390,367 issued in February, 1994, to Rush, III and discloses an inflatable protective means to protect the cervical spine. U.S. Pat. No. 5,444,870 to Pinsen issued in August, 1995 and discusses a helmet nested within a shoulder mounted cradle. U.S. Pat. No. 5,517,699 to Abraham, II, issued in May 1996, describes a post attached to a shoulder pad with a hood superposed above a helmet on the wearer. U.S. Pat. No. 5,553,330 to Carveth, issued in October 1996, is a helmet spaced to be high above the apex of the head of the wearer. The helmet is held in position through cantilever supports with pads that rest on the head of the wearer. Upon impact to the top of the helmet, the helmet is pushed down onto the user's shoulders. U.S. Pat. No. 5,794,270 to Howat, issued in August 1998, discloses an outer second head covering mounted on a shoulder pad. A first head is disposed within the second head covering and is rotatable within the second covering on four spherical spaced apart bearings.

3. Medical Aspects

Catastrophic injuries often occur in football and hockey due to excessive axial loading on the cervical spine. Such injuries are now occurring more frequently because the players are much larger and weigh considerably more than in previous years. Although there has been a great deal of improvement in helmets, the magnitude of kinetic energy generated by impacts cannot be dissipated by the current generation of protective headwear. Therefore, there is a need for a protective head apparatus that offers the maximum protection to their head/brain, central nervous system/cervical spine. Furthermore, it would also be advantageous for a player to have full mobility of motion of the head and good all-around visibility.

SUMMARY OF THE INVENTION

A primary object of this invention is to provide a high energy absorbing structure that can be attached to existing shoulder pads worn by football players and hockey players that prevents head, neck and devastating cervical spine injuries. In this invention, the kinetic energy of an impact to the apparatus structure is attenuated by a shock absorbing system whereby the energy of the impact is transmitted to the shoulder pad and thence to the shoulders of the wearer. The apparatus of the present invention makes impossible axial loading of the cervical spine due to the open space between the crown of the structure and the head of the wearer. The apparatus of the present invention also makes impossible a direct impact to the head of the wearer and the possibility of a concussion is virtually eliminated. The apparatus of the invention is spaced apart and all around the head of the wearer, allowing a complete range of motion of the head. However, the range of head motion may be limited by an energy distributing and dissipating annular band that reduces high acceleration forces from whiplash type impacts that can cause injuries to the brain.

The design and construction of the protective head cage apparatus makes it readily adaptive for many different applications. Preferably, the size and weight is similar to that of existing helmets. Attachment of the apparatus to shoulder pad relieves the wearer of the weight of a helmet on his head and neck. Additionally, the wearer's brain will not be subjected to the higher acceleration forces due to the weight of the helmet. One of the outstanding features of the apparatus is that it can be optimized for specific ranges of weights of wearers and readily adapted for the sports or industrial applications or environments.

DETAILED DESCRIPTION OF THE PREFERRED EMBODIMENTS

Figure 1:
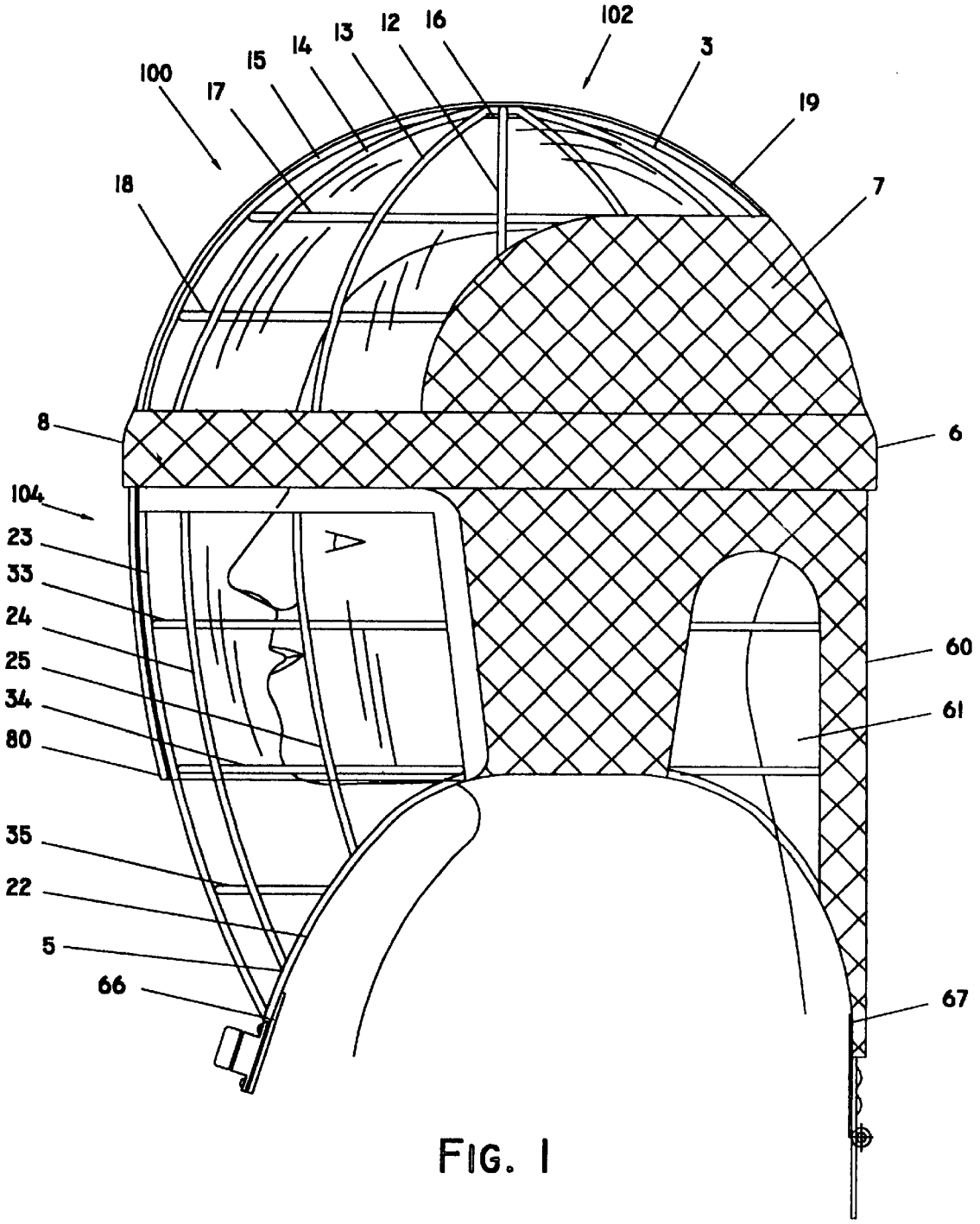
FIG. 1 is a left side elevation view of the head cage assembly with outer covers as it would be mounted on a conventional shoulder pad for a football player with the opaque area of the crown cover and of the lower support structures indicated by a net pattern.

Referring now to the details of the drawings in which like reference characters denote like elements throughout the several views. FIG. 1 is a left side elevational view of the shoulder pad mounted protective head cage assembly 100. The assembly 100 comprises a crown structure sub-assembly 102 including a cage type spring steel round wire weldment 3 having an outer cover 19 with a transparent area extending from behind the eyes and arcuately upward and back partly over the vertex area. A lower support structure sub-assembly 104 has a cage type spring steel round wire weldment 5 that is open in the front portion with a cover 60 extending from approximately the center on each side of the sub-assembly 104 and around the back of the apparatus.

An area 6 between the crown structure sub-assembly 102 and the lower support structure sub-assembly 104 comprises convoluted shock absorbing horizontal and vertical springs which are attached to both sub-assembly structures to join them together. The area 7 on the sides of the sub-assembly 102 is arcuately upward partly over the crown cover 19 and extending around the back is opaque, as is the whole outer cover 60 of the lower support structure sub-assembly 104 as indicated by textured pattern.

Figure 2:
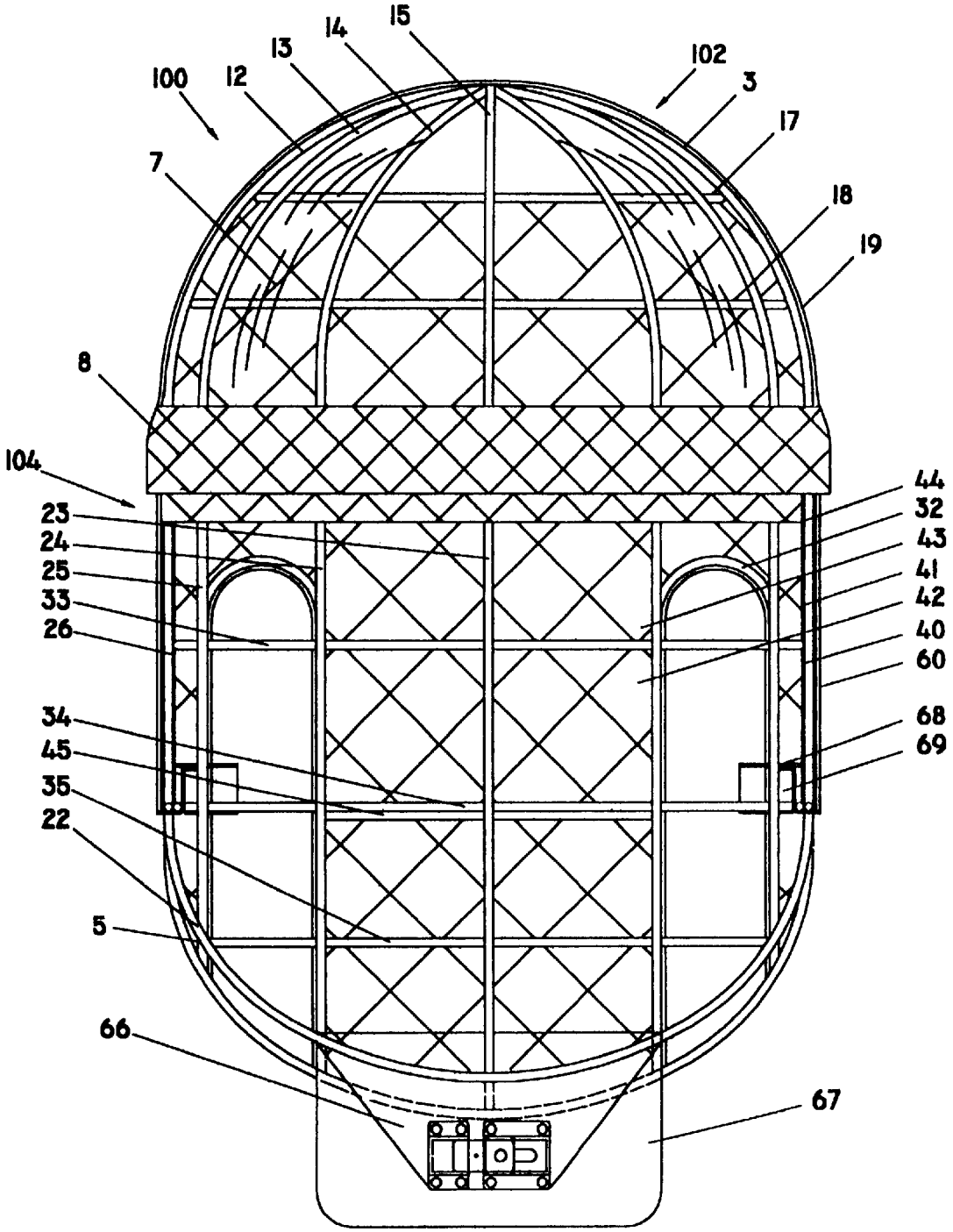
FIG. 2 is a front elevation view of the head cage assembly with outer covers, with the opaque areas indicated in a net pattern, and with the inside opaque surfaces indicated in a larger net pattern, and showing a front latch assembly.

As seen in FIG. 2, a front elevation view of the head cage assembly 100, the area 8 across the bottom front of the crown cover and around the top of the lower support structure are opaque as indicated by the textured pattern. The inside back areas of the two structures are opaque as indicated with a larger net pattern.

Figure 3:
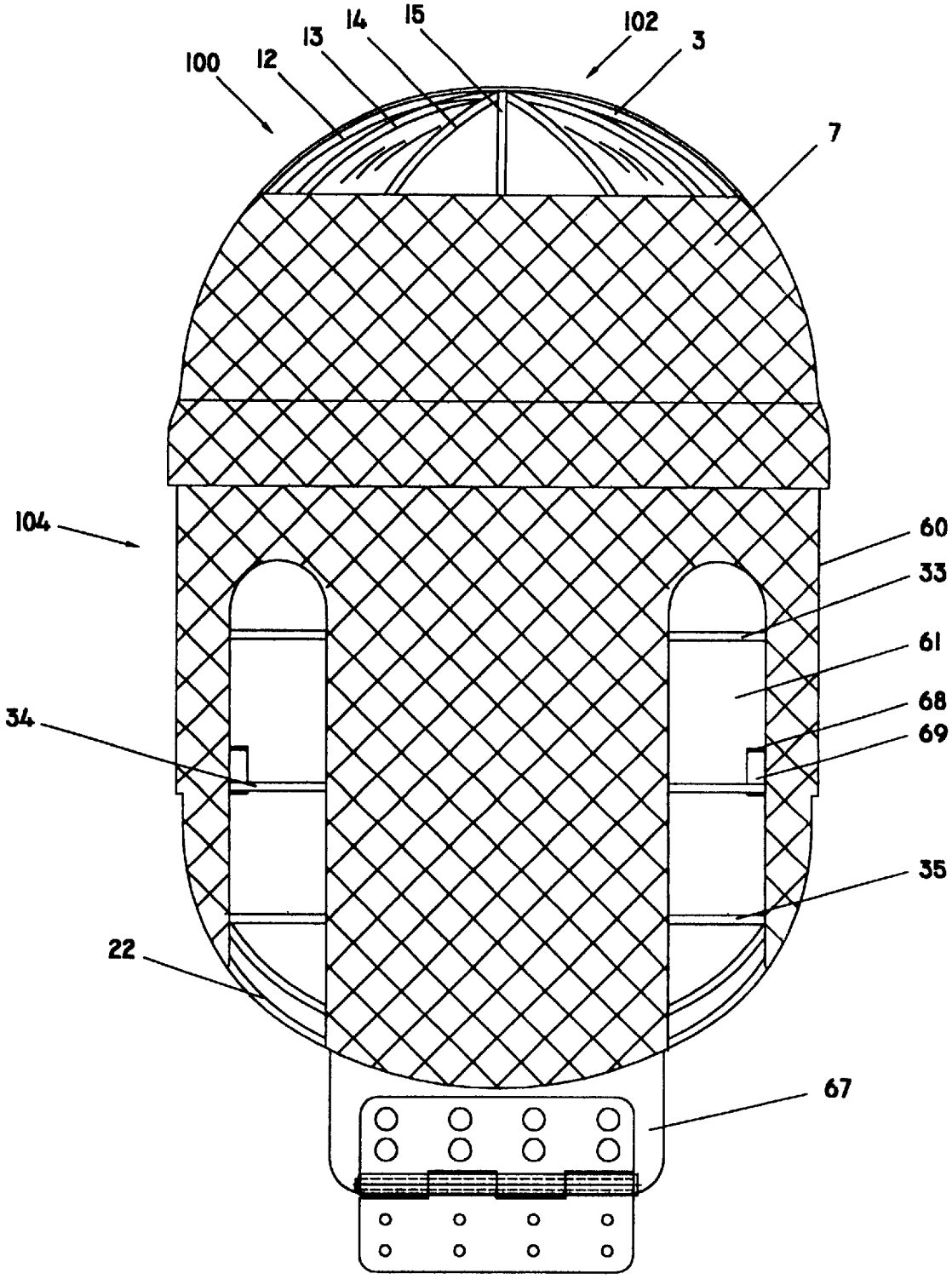
FIG. 3 is a back elevation view of the head cage assembly with outer covers with the opaque areas indicated in a net pattern, and showing a back hinge assembly.
Figure 4:
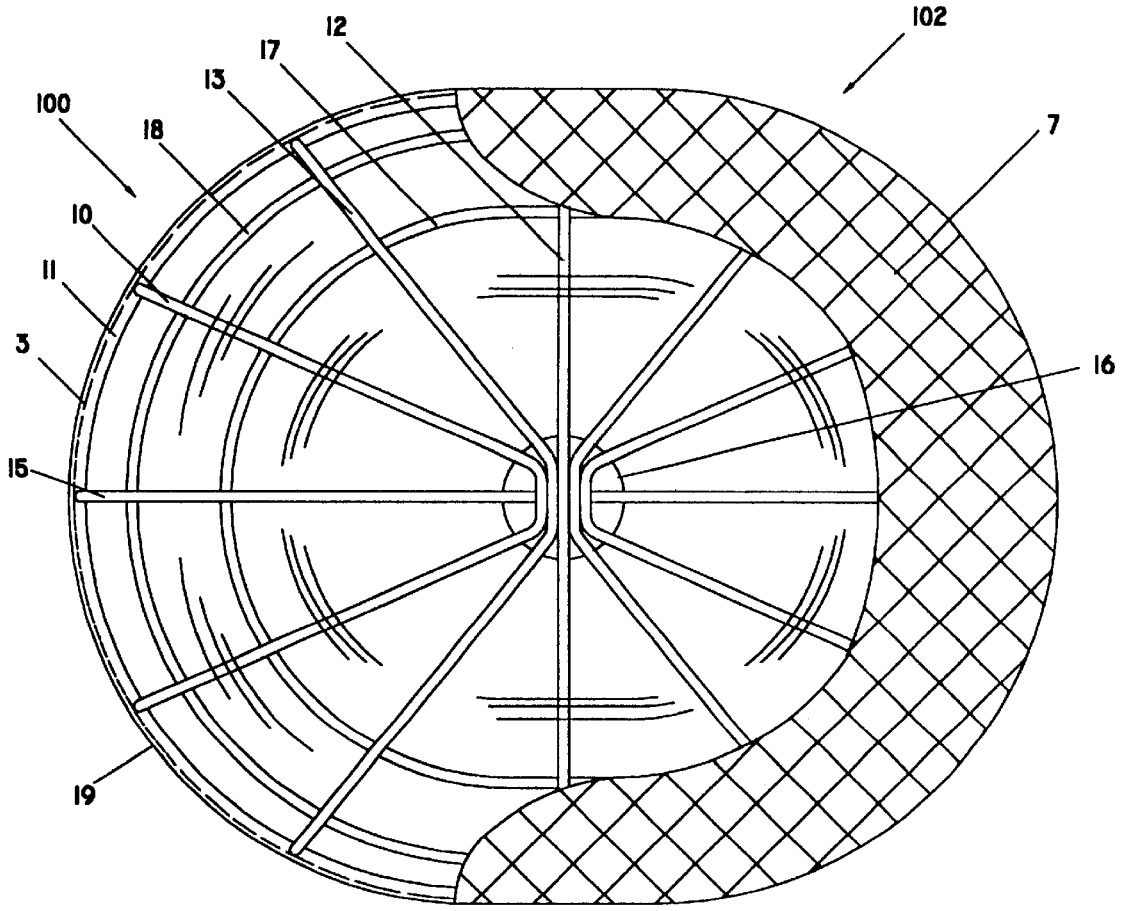
FIG. 4 is a top plan view of the head cage assembly with the opaque area of the crown piece indicated in a net pattern.

Referring to FIG. 3, a back elevation view of the head cage assembly 100, the areas that are opaque on the crown cover 19 and on the lower support structure outer cover 60 are indicated with the same textured pattern as shown in FIG. 1. In FIG. 4, a top plan view of the head cage assembly 100, the opaque area of the crown cover 19 is indicated by the textured area 7.

Figure 5:
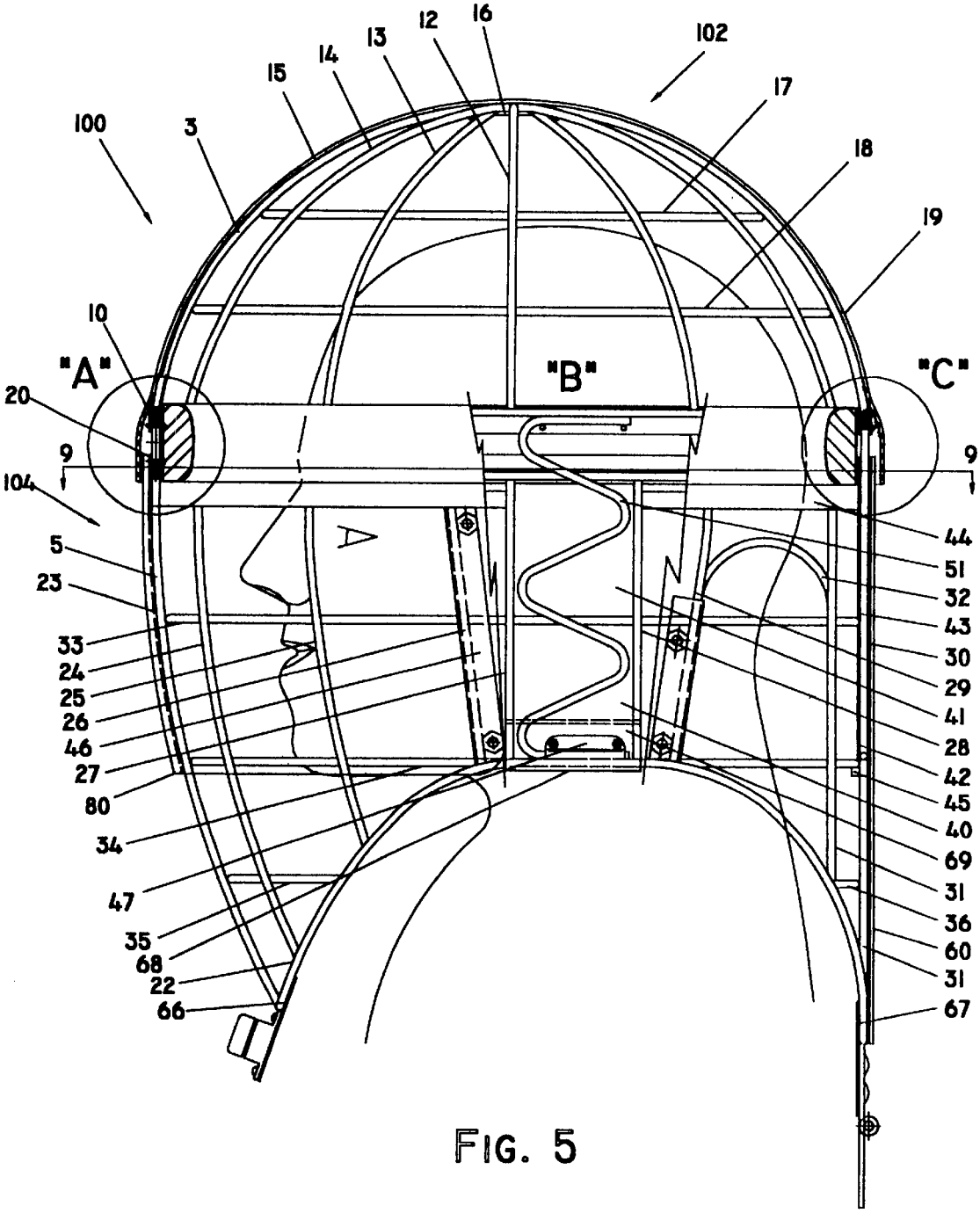
FIG. 5 is a fragmentary left side view of the head cage with the outer covers shown only in cross section and including cross section details of the interconnecting springs between the crown structure and lower support structure, and also showing the energy absorbing annular band, with details "A," "B" and "C" indicated.

Referring now to FIG. 5 there is shown a left side elevation view of the head cage assembly 100 with the outer cover 19 of the crown structure sub-assembly 102. The outer cover 60 of the lower support structure sub-assembly 104 is removed with those outer covers being shown in cross-section. Three detail areas "A," "B" and "C" are indicated showing, in cross-section, details of the interconnecting shock absorbing horizontal and vertical springs between the crown structure sub-assembly 102 and the lower support structure subassembly 104. Enlarged views of details "A," "B" and "C" are shown in FIG. 11.

In the descriptions that follow, the structure weldments of the crown structure sub-assembly 102 and the lower support structure sub-assembly 104 are preferably constructed of spring steel round wire. Therefore, whenever reference is made to straight, arcuate, horizontal or vertical elements, these elements are made of spring steel round wire unless described otherwise.

Figures 11, 12, 13:
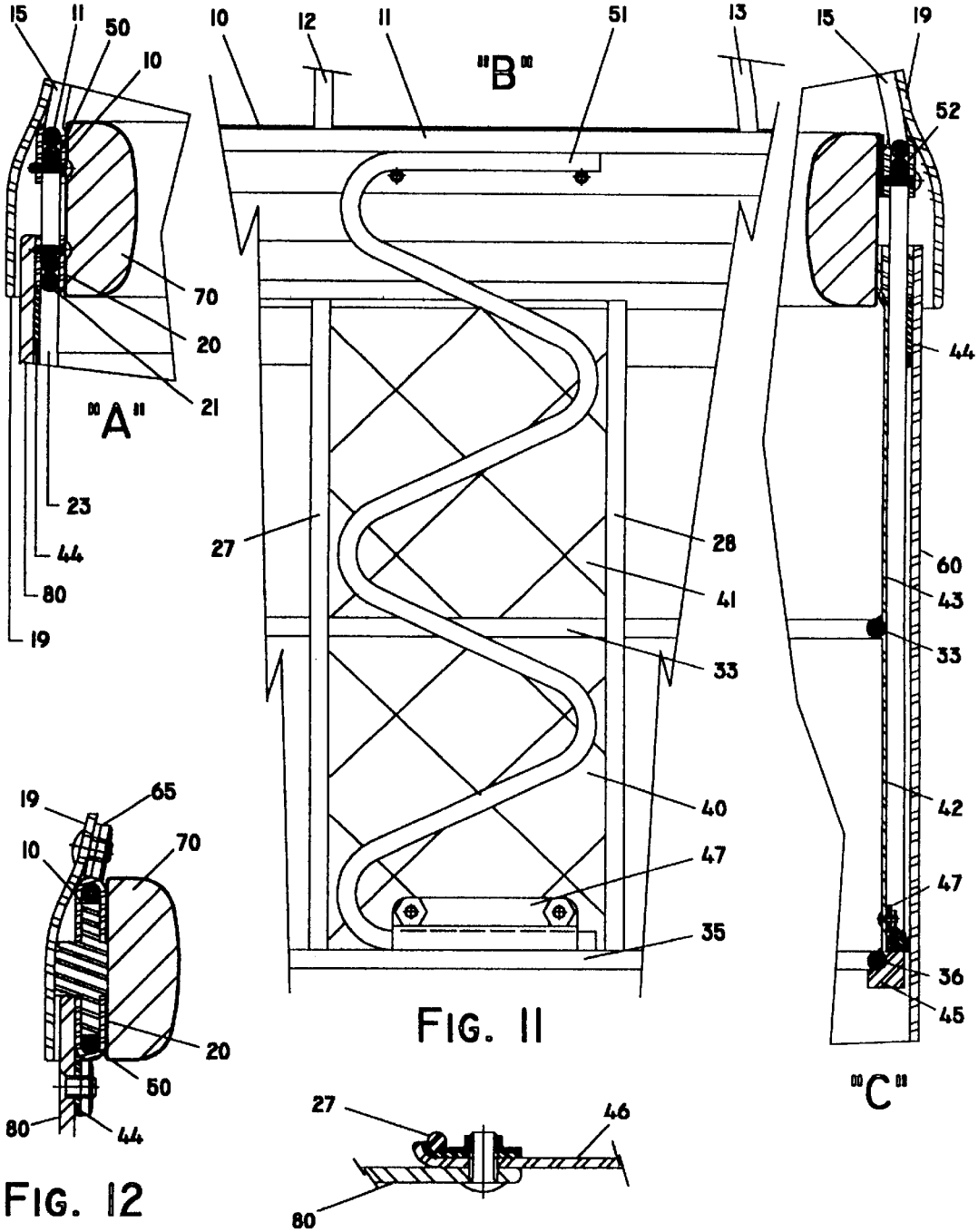
FIG. 11 shows in enlarged views details "A," "B" and "C" of FIG. 5.
FIG. 12 is an enlarged view of an alternate construction of an energy absorbing annular band.
FIG. 13 is an enlarged cross section showing the use of truss head machine screw and T-nut to attach a single panel face shield to the J-strip on a vertical element.

As seen in FIG. 11, the crown structure sub-assembly 102 consists of a U-shaped thin steel channel 10 that extends around the circumference at the bottom of the crown structure weldment 3 (seen FIG. 1) with the flanges facing downward. In the horizontal plane the U-shaped channel 10 is an oblong oval. A horizontal element 11 is shaped to fit inside the top of the U-shaped channel 10 and is welded to be one continuous element. There are holes in the top surface of the U-shaped channel 10 for positioning arcuate vertical element 12 and two sets of arcuate vertical elements 13, 14 and 15 that are welded together at the apex of the crown structure 3 and at the bottom, to the top of element 11 and to channel 10.

Figure 8:
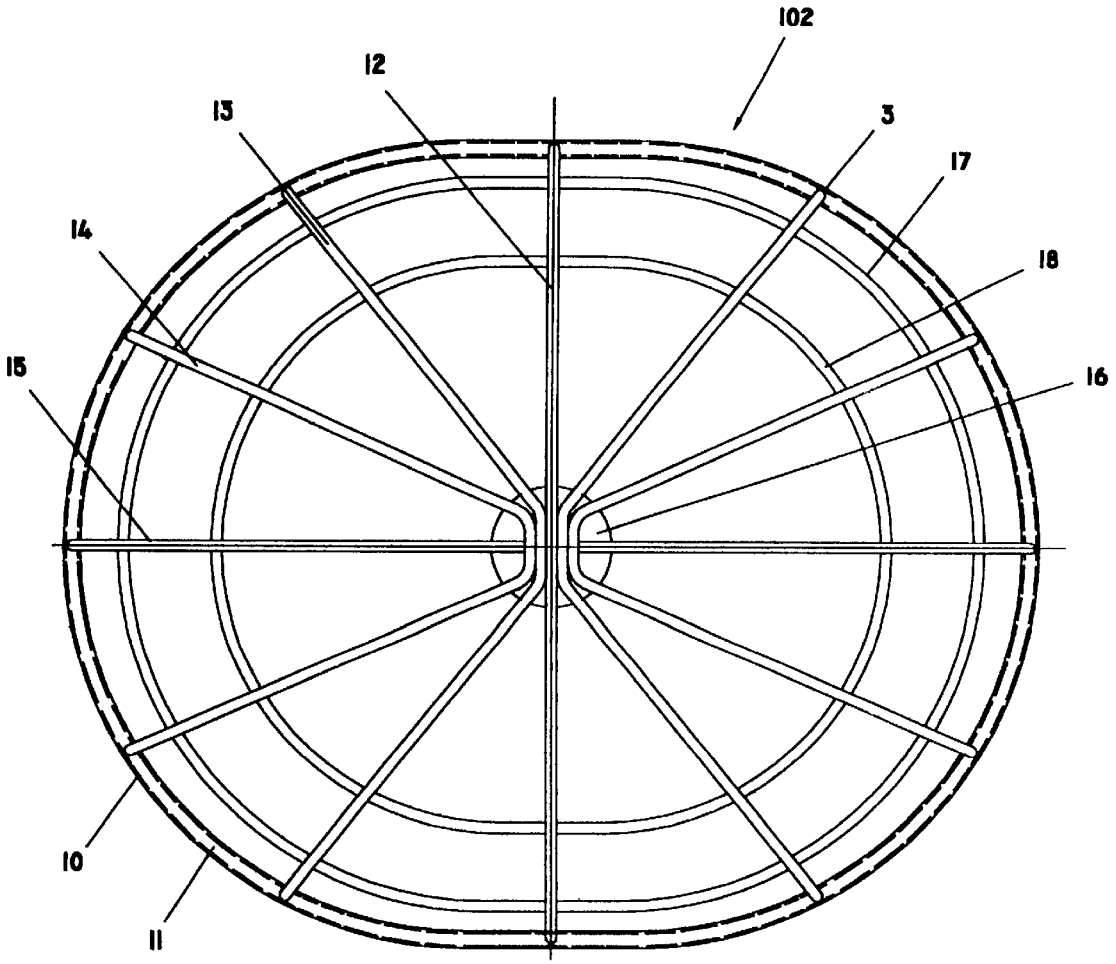
FIG. 8 is a top plan view of the crown structure weldment with the outer cover removed.

As shown in FIG. 8, a top plan view of the crown structure weldment 3, the arcuate vertical element 12 extends from the center top on the left side of the horizontal element 11 to the center top right side of the horizontal element 11. Arcuate vertical element 13 extends from a point on the top of the horizontal element 11 that in the plan view is at an angle of 30 degrees clockwise to arcuate vertical element 12. Element 13 extends arcuately upward toward the apex of the arcuate vertical element 12. Element 13 is then formed to be adjacent to element 12 for about three-quarters of one inch and it is then formed to an angle 30 degrees counterclockwise to arcuate vertical 12 and continues arcuately downward to the top of the horizontal element 11 to which it is welded.

Arcuate vertical element 14 extends from a point on the top of the horizontal element 11, that in the plan view is at an angle of 30 degrees clockwise to the arcuate vertical element 13. Element 14 is then formed at the vertex to be adjacent that element for about one-half inch where it is formed to an angle 30 degrees counterclockwise to arcuate vertical element 13. Element 14 next continues arcuately downward to the top of the horizontal element 11 to which it is welded. Arcuate vertical element 15 is welded to the top at the front center of the horizontal element 11, extends to the vertex at the center front of the arcuate vertical element 14.

A second set of arcuate elements that are the same as elements 13, 14, and 15 are positioned through the holes in the top of the U-shaped horizontal channel 10 toward the back and welded to the top of the horizontal element 11 and to each other at the vertex. A circular steel disc 16 is welded to the bottom of the arcuate vertical elements on the inside at the vertex.

Two other horizontal elements 17 and 18, preferably oblong oval in shape in the horizontal plane, are welded to the inside of all of the arcuate vertical elements. Elements 17 and 18 are preferably equally spaced vertically between the top horizontal channel 10 and the inside of the apex of the crown structure weldment 3.

When assembled into a weldment, the crown structure sub-assembly 102 forms an oblong hemisphere over which, preferably, a transparent polycarbonate shell cover 19 is attached with small flat head screws to the brackets 65 (see FIG. 12) welded to the U-shaped channel 10. The brackets preferably having hex nuts welded to them. The transparent shell cover 19 can be painted on the inside surface across the bottom front to cover the area 8 over the interconnecting springs between the crown structure sub-assembly 102 and the lower support sub-assembly structure 104. Area 7 (see FIG. 1) just forward of the center on each side that extends arcuately upward about midway then extends back circularly may also be painted, leaving the balance of the area transparent for visibility overhead. The polyearbonate shell cover 19 may also be tinted to reduce the sun's rays and thereby reduce the temperature inside the apparatus.

The polycarbonate shell cover 19 being hemispherical in shape will redirect the head cage assembly 100 upon its contact with another surface thereby reducing the force of the impact. The shell cover 19 being hemispherical will also keep the head cage assembly 100 from impinging on a contacting surface. The shell cover 19 will also protect the wearer from rain and snow.

The primary purpose of the crown structure sub-assembly 102 is to distribute the force of an impact over as large an area as possible through the use of the arcuate vertical elements 12, 13, 14 and 15. The force of impact is next distributed through to the convoluted interconnecting shock absorbing horizontal springs 50 and the convoluted interconnecting shock absorbing vertical springs 51 and 52 between the crown structure sub-assembly 102. The force is transmitted on to the through the lower support structure sub-assembly 104 and then on to the shoulder pads and on to the shoulders of the wearer.

The lower support structure sub-assembly 104 consists of a spring steel round wire weldment 5 assembled as shown in FIGS. 1 through 13. As shown in FIG. 11, at the top of the sub-assembly 104, a steel U-shaped horizontal channel 20 with the flanges facing upward is formed into an oblong oval in the horizontal plane to be preferably the same size as the U-shaped channel 10 in the bottom of the crown structure weldment 3. Slots in the bottom of the U-shaped channel 20 for the interconnecting shock absorbing vertical springs to pass through, are shown in FIGS. 10 and 11.

Figure 9:
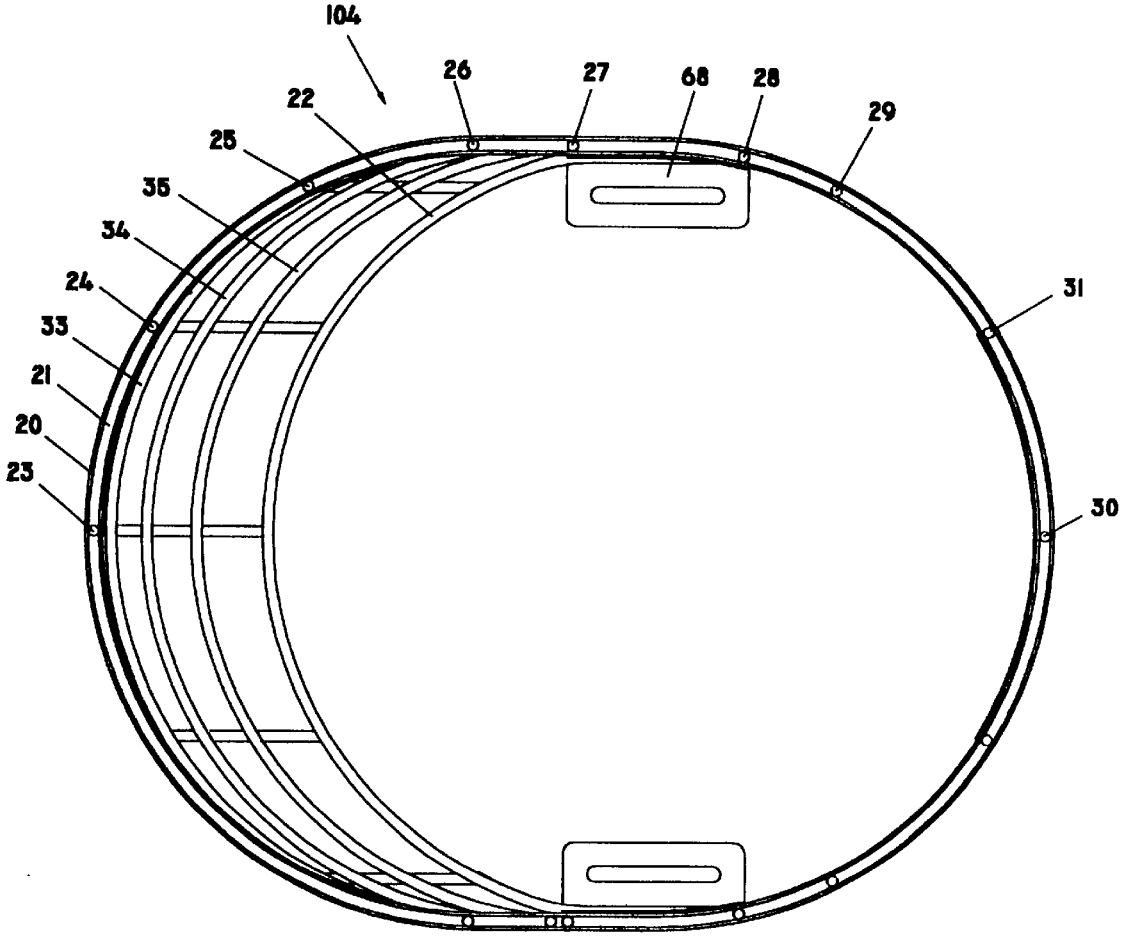
FIG. 9 is a cross section view of the lower support structure taken along line 9—9 of FIG. 5.

As shown in FIG. 9, a horizontal element 21, formed to fit within the bottom of the U-shaped channel 20 is divided into three segments with the slots for the shock absorbing vertical springs being between the segments.

As seen in FIG. 5, at the very bottom of the lower support structure weldment 5 is a compound curve shaped element 22 extending across the chest area at the front and arcuately upward over both shoulder areas and then arcuately downward across the upper portion of the back where it is butt welded to form one continuous element. Holes are formed in the bottom of the U-shaped steel channel 20 for positioning arcuate and straight vertical elements. At the center of the front of the lower support structure weldment 5 is welded an arcuate shaped vertical element 23 that is welded to the horizontal element 21 within the U-shaped horizontal channel 20 at the top center. Arcuate vertical elements 24 and 25 are on each side at the front. Straight vertical elements 26, 27, 28, 29 are on both sides, and a straight vertical element 30 is at the center in the back with a straight vertical element 31 on each side. All of the arcuate and straight vertical elements are welded to the compound curved element 22 at the bottom of the lower support structure weldment 5 and to horizontal element 21 within the U-shaped steel channel 20 at the top. The vertical element 26 is at a forward cant and the vertical element 29 is at a rearward cant to thereby make the lower support structure weldment 5 more resistant to distortion. There is a small compound curved element 32 positioned about one inch below the U-shaped channel 20, that is welded between vertical elements 29 and 31 on both sides of the weldment 5.

Figure 10:
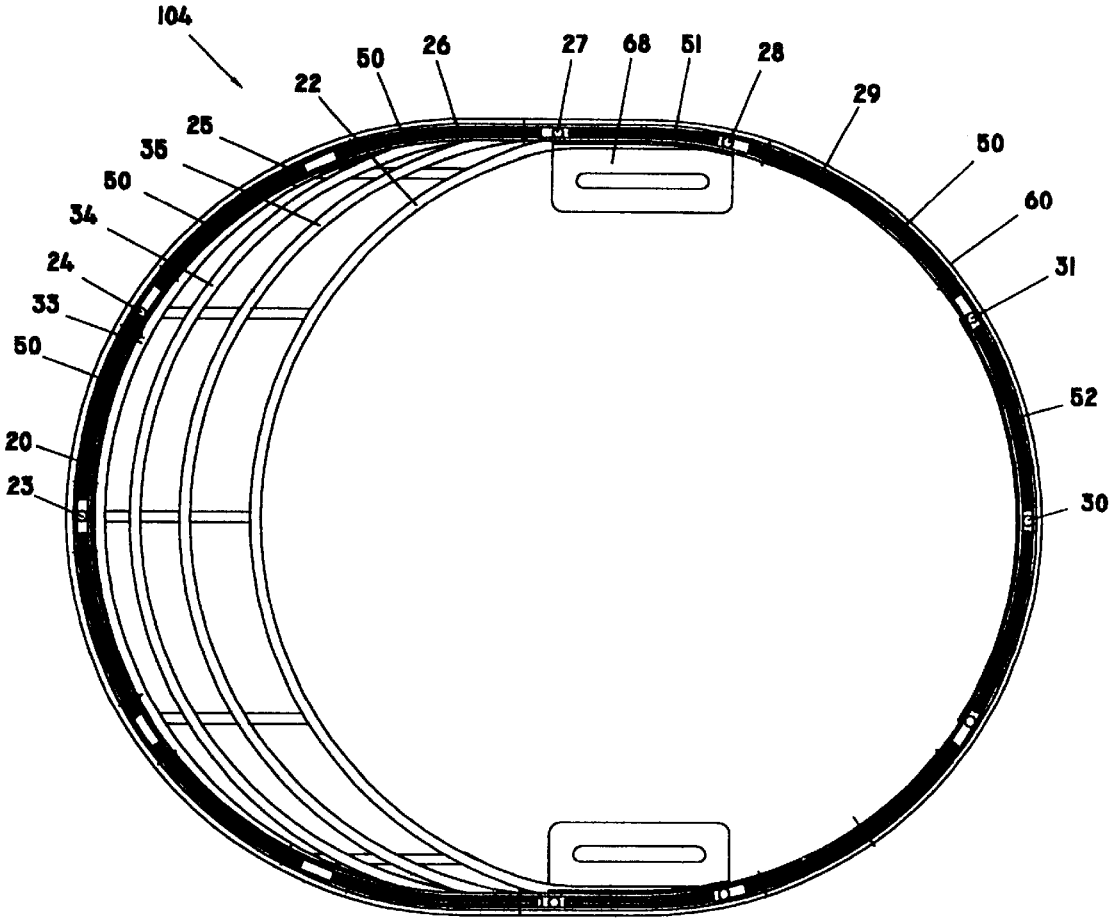
FIG. 10 is a top plan view of the lower support structure with all of the shock absorbing springs in their proper positions.

As seen in FIG. 10, horizontal elements 33 and 34 are preferably oblong ovals and have the same radius as the top horizontal element 21 but are shorter in length. They are welded to the inside of all of the arcuate vertical elements, with the shortest horizontal element 34 being welded to the bottom compound curved element 22 on the inside and at the top of the arch area that extends over the shoulder portion of the shoulder pad. The horizontal element 33 is positioned to be midway between the bottom of the horizontal element 21 at the top and horizontal element 34 at the bottom. Another horizontal element 35 having the same radius as horizontal element 34 is positioned in the front and midway between the bottom of horizontal element 34 and the top of the compound curved element 22 that extends around the bottom of the lower support structure weldment 5. Still another horizontal element 36 having the same radius as the horizontal element 34 is positioned at the back and midway between the bottom of horizontal element 34 and the top of element 22 at the bottom of the lower support structure weldment 5. A thin sheet metal panel 40 (see FIG. 7) is welded on the back of vertical elements 27 and 28 and between horizontal elements 33 and 34. Another thin sheet metal panel 41 is welded to the back of vertical elements 27 and 28 and extends from the top of horizontal element 33 upward and is formed around the back of the U-shaped horizontal channel 20 at the top of the lower support structure weldment 5 and is welded to it. In a similar manner two thin sheet metal panels 42 and 43 are welded in the back of the lower support structure on the left and on the right between the vertical elements 30 and 31 and between the horizontal elements 33 and 34 and between the horizontal elements 21 and 33, extending from the top of the horizontal element 33 and is formed around the back of the U-shaped horizontal channel 20 at the top and is welded to it.

The panels 42 and 43 contribute to making the lower support structure weldment 5 more resistant to distortion. A narrow thin steel strip 44 extends around the perimeter on the outside at the top of all of the vertical elements and is welded to those vertical elements and to the bottom of the U-shaped horizontal channel 20. A steel bar 45 that is one quarter of one inch thick and extends laterally from the outside surface of vertical element 31 on both sides of the center vertical element 30, is machined to a radius in the horizontal plane to match the inside of the horizontal element 34 and an outside radius to match the outside of the vertical elements 30 and 31 and having a notch at the center for the vertical element 30 and at each end for the vertical elements 31. The bar 45 is machined with a step toward the inner edge to a width and depth to fit underneath the horizontal element 34 as shown in FIG. 11. The horizontal bar 45 is welded to the bottom of the horizontal element 34 and the vertical elements 30 and 31. A narrow thin steel J-shaped strip 46 with the flange toward the back is welded to the outside of vertical element 26 on each side of the lower structure weldment 5 as shown in FIG. 13.

As best seen in FIG. 5, convoluted shock absorbing vertical springs 51 are positioned between vertical elements 27 and 28 on both sides of the lower support structure weldment 5. These springs are retained in position at the bottom by a long narrow J-shaped steel clip 47 that is attached to the sheet metal panel 40 as shown in FIG. 11.

Figure 6:
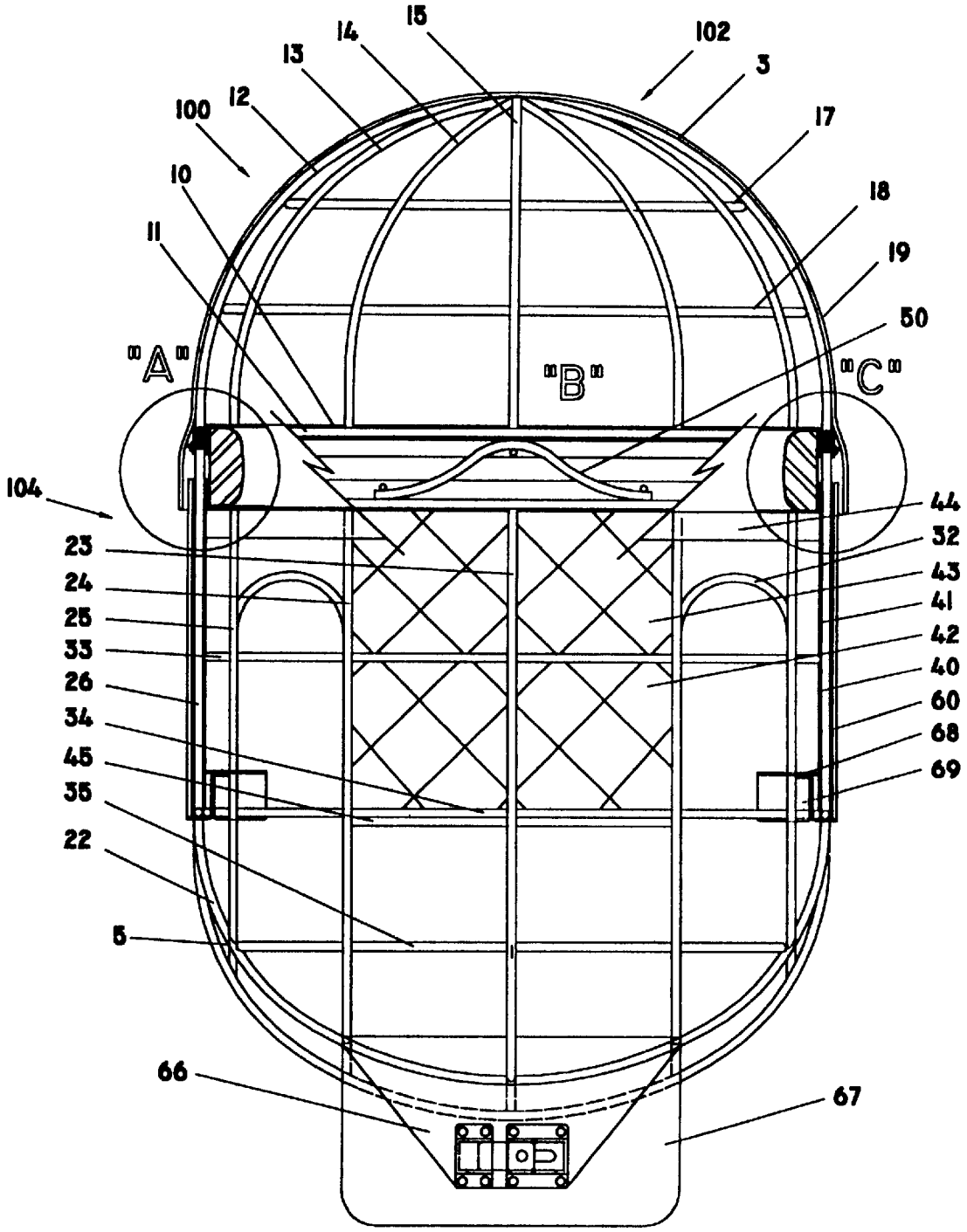
FIG. 6 is a fragmentary front elevation view of the head cage assembly with the outer covers removed, with the inside of the panels in the center in the back indicated in a large net pattern, and also showing an interconnecting vertical shock absorbing spring, and a front latch assembly.

In a similar manner two convoluted shock absorbing vertical springs 52 located at the back, to the left and to the right of the center vertical element 30 positioned as shown in FIG. 6. The springs 52 are retained in position by two more J-shaped clips 47 attached to the sheet metal vertical panels 42. The convoluted shock absorbing vertical springs 51 and 52 in top plan view conform to the radius of the U-shaped channel 10 at the bottom of the crown structure weldment 3 within which they fit. A thermoformed plastic outer cover 60 extends from the front of the J-shaped strip 46 that extends over the vertical element 26 on the left side of the lower support structure weldment 5 and around the back to the front of the J-shaped strip 46 that is over the vertical element 26 on the opposite side. The plastic cover 60 may be of transparent polycarbonate which can be readily painted on the inside surface so as not to show scratches, or it may be of fiberglass/graphite unidirectional fiber composite plastic with the unidirection being vertical. The edges of the plastic cover 60 over the lower support structure weldment 5 are preferably formed to be over the front surface of the J-shaped strips 46 on the vertical element 26, the back surface of vertical element 29, flush with the bottom surface of the compound curved element 22 and over the side surface of the vertical element 31, being the same on both sides of the lower support structure sub-assembly 104. The plastic cover 60 has U-shaped openings 61 on both sides at the back to provide a free flow of air through the lower support structure sub-assembly 104. Short J-shaped thin steel segments 65 are welded to the compound curve formed element 22 in several locations for attaching the plastic cover 60 to it with flush head rivets or, in an alternate method, with truss head machine screws and T-nuts as shown in FIG. 13. The plastic cover 60 is preferably attached to the narrow metal strip 44 at the top with flat head rivets or with truss head machine screws and hex nuts or T-nuts welded on the inside surface.

Small metal plates 66 and 67 of the proper shape and size are welded to the compound formed element 22 at the front for mounting a latching device and at the back for mounting a hinge device, respectively. Two Z-shaped brackets 68, as shown in FIG. 6, are welded at the bottom, with the long, flange toward the inside, on the left and right sides of element 22 of the lower structure weldment 5 in the apex of the arch over the shoulder areas. These brackets are for mounting composite plastic pads 69 that conform to the contour of the top surfaces of the shoulder pad. The composite plastic pads make it possible to adjust the head cage assembly 100 fore and aft in relation to the top of the shoulder pad. Other J-shaped metal brackets 65 with steel T-nuts welded to the inside surface, of the proper shapes and sizes are welded to the vertical or horizontal elements where needed for the attachment of a transparent polycarbonate face shield as shown in FIG. 13.

Prior to assembly of the crown structure sub-assembly 102 and the lower support structure sub-assembly 104 into a single assembly, both of the structure weldments without covers and the interconnecting springs attached are preferably plated so as to be rust resistant and then heat treated to a minimum Rockwell 40 hardness. If desired, the weldments can also be dip coated in a plastic of any desired color.

Figure 7:
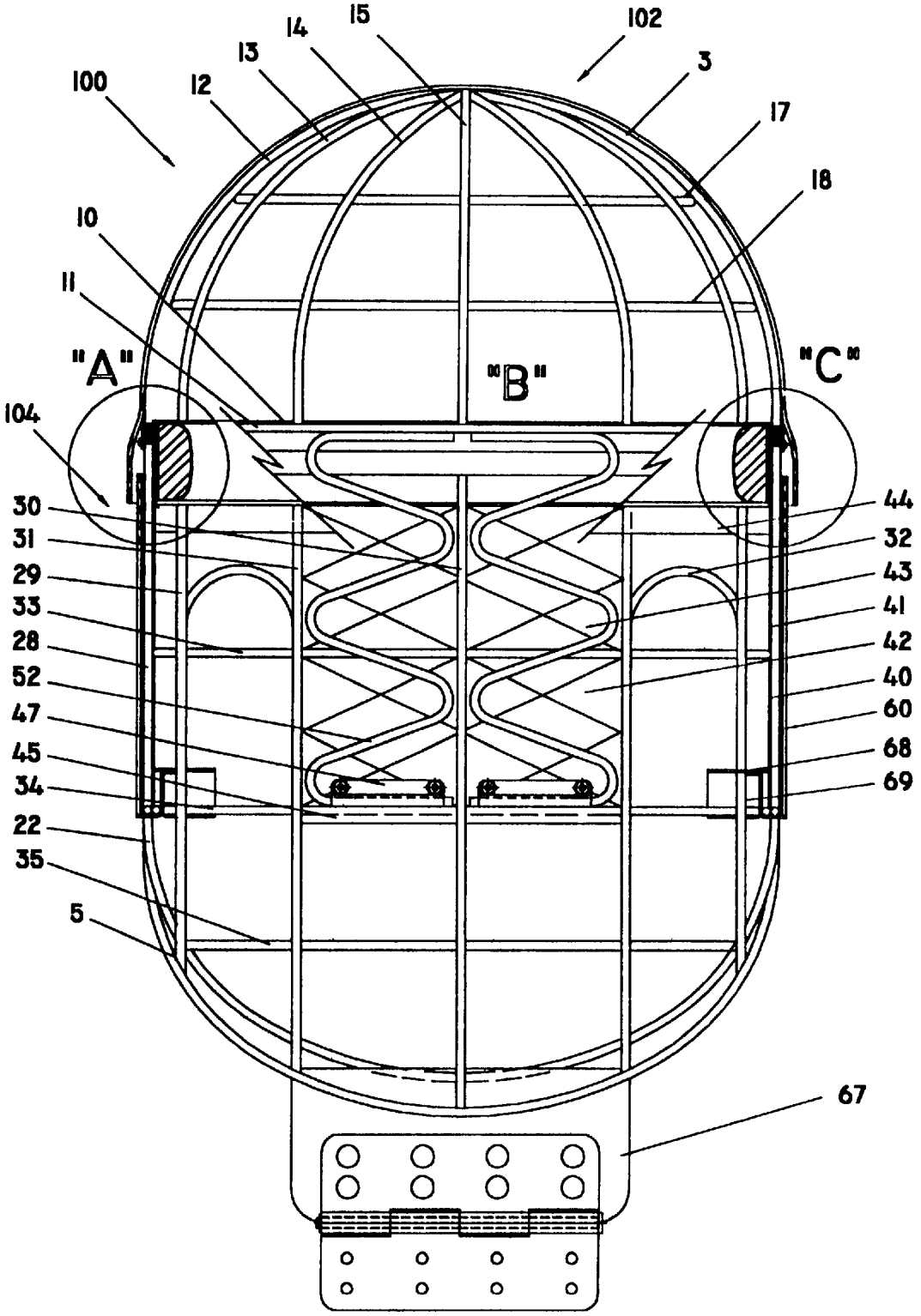
FIG. 7 is a fragmentary back elevation view of the head cage assembly with the outer covers removed, showing in the center the convoluted vertical shock absorbing springs, and the back hinge.

Assembly of the crown structure sub-assembly 102 and the lower support structure sub-assembly 104 into the unit head cage assembly 100 is accomplished in the procedure as hereinafter outlined. To begin the final assembly the crown structure weldment 3 outer cover 19 and lower support structure weldment 5 outer cover 60 are left off in order to have access to all areas. The convoluted interconnecting shock absorbing horizontal springs 50, shown in FIGS. 6, 7, and 11, arc positioned within the U-shaped horizontal channel 20 at the top of the lower support structure weldment 5 and retained with escutcheon pins through the U-shaped channel across the inside of the flat portions of the convolutions at the bottom of the springs as shown in FIGS. 5, 7 and 11. The convoluted shock absorbing vertical springs 51 and 52 are lowered through the slots in the bottom of the U-shaped channel 20 at the top of the lower support structure weldment 5 and retained in their respective positions with J-shaped clips 47 at the bottom center, with the J-clips 47 being attached to the vertical sheet metal panels behind the springs with flat head rivets or number 4–36×⅛ inch long truss head machine screws and hex nuts on the outside surface of the J-shaped clips as shown in FIG. 11.

The crown structure weldment 3, without the cover 19 attached to it, is positioned over all of the shock absorbing springs with the apex of the center convolutions of the shock absorbing horizontal springs 50 and the top portions of the convoluted shock absorbing vertical springs 51 and 52 nested firmly against the spring steel round wire element 11 that is within the U-shaped channel 10 around the bottom of the crown structure weldment 3. The convoluted shock absorbing horizontal springs 50 are secured with escutcheon pins across the bottom of the apex of the center convolution of the spring as shown in FIGS. 5, 6, 7 and 11. The convoluted shock absorbing vertical springs 51 and 52 are retained in the U-shaped channel 10 at the bottom of the crown structure weldment 3 with escutcheon pins across the bottom horizontal portions as shown in FIG. 11. The lower support structure cover 60 is properly positioned over the lower support structure weldment 5 and attached to it with small truss head machine screws and nuts as shown in FIG. 13.

As seen in FIG. 11, a strip of closed cell foam of a density of four pounds that has been compression formed into the shape and has a fabric under the trade name ETC bonded to it, is formed into an oblong oval band 70 to fit on the inside surface of the inner flange of horizontal channel 10. The shock absorbing annular band 70 is preferably adhesively bonded to the inside surface of the U-shaped channel 10 at the bottom of the crown structure weldment 3 and to the inside surface of the horizontal channel 20 at the top of the lower support structure weldment 5.

A thin dual panel transparent polycarbonate face shield 80, preferably thermoformed or injection molded, is of compound curvature and extends from the back edge of the J-shaped strip on the outside surface of the vertical element 26 on one side of the lower support structure weldment 5 around the front, to the back edge of the J-shaped strip on the outside of the vertical element 26 on the opposite side of the lower support structure weldment 5 and from the top of the lower support structure weldment 5 to the bottom of the horizontal element 34. The face shield 80 is attached to the weldment 5 with truss head machine screws near the top and bottom of the vertical element 26 on both sides of the weldment 5 and at the top to the perimeter steel band 51 midway between front center vertical element 23 and vertical elements 24 on each side of the lower structure weldment 5 as shown in FIG. 12 and 13.

In an alternate construction of the shock absorbing annular band 170, a laminate of two different densities of closed cell foam that have been die cut and compression formed to specific sizes and shapes are bonded together, and are formed into an oblong oval band having a cross section as shown in FIG. 12. An EVA closed cell foam having a shore durometer hardness of 50 to 60 is compression formed to form a flange that will conform to the inside of the U-shaped channel 10, that is in the bottom of the crown structure weldment 3 and to the inside of the U-shaped channel 20, that is in the top of the lower support structure weldment 5 and has a center portion that extends outward between the flanges of channels 10 and 20 to the inside surface of the flange that depends in spaced relation to the top of the lower support structure when the two structures are assembled together, and is flush with the inner surfaces of the U-shaped channels 10 and 20. An EVA closed cell foam of a shore durometer 30 to 40 is compression formed with a cross section as shown in FIG. 12 for the inner portion of the annular band. This portion is covered with a fabric under the trade name ETC and adhesively or heat bonded to the higher density portion.

A first alternate embodiment of a shoulder mounted protective head cage assembly 200 is shown in FIGS. 14 through 17. This protective head cage assembly consists of a crown structure sub-assembly 202 and a lower support structure sub-assembly 204 that are preferably constructed of fiberglass/graphite, random and unidirectional fiber composite plastic. The crown structure has a compression formed oblong oval ring 210 at the bottom that has a flange that depends in a spaced relation horizontally when the crown structure sub-assembly 202 is connected to the lower support structure sub-assembly 204. There is a recess in the bottom surface of the oblong oval ring inside of the flange with a radius groove for nesting shock absorbing horizontal and vertical springs. There is a recess 209 around the outside of the top surface for mounting a transparent polycarbonate crown piece.

The lower support structure sub-assembly 204 preferably comprises a compression formed fiberglass/graphite random fiber composite plastic top 220 and bottom 222 rings, with a compression formed fiberglass/graphite unidirectional fiber composite plastic vertical panel 260 between the rings. The top ring 220 is preferably the same size and shape as the ring 210 at the bottom of the crown structure and has recesses corresponding to the recesses in that ring for shock absorbing horizontal springs. The ring includes slots in the top surface for the shock absorbing vertical springs to pass through to nest in the corresponding recesses for the shock absorbing vertical springs. A recess is defined in the ring around the outer bottom surface for bonding the unidirectional fiber composite plastic vertical panel 260 at the sides and around the back, and for attaching a face shield around the front. The bottom compression formed fiberglass/graphite random fiber composite plastic ring 222 preferably conforms to the surface of the shoulder pad across the front, arcuately upward over the shoulder areas and arcuately downward over the upper portion of the back. Holes are defined in the bottom surface of the top ring 220 and in the top surface of the bottom ring 222 and in the front surface of the vertical panel 260 for the mounting of an open grid type face guard weldment 281 during assembly of the lower support structure. Z-shaped brackets 268 for mounting adjustable positioning pads 269 are rigidly attached to the inside of the bottom ring at the apex of the shoulder area on each side.

Figure 14:
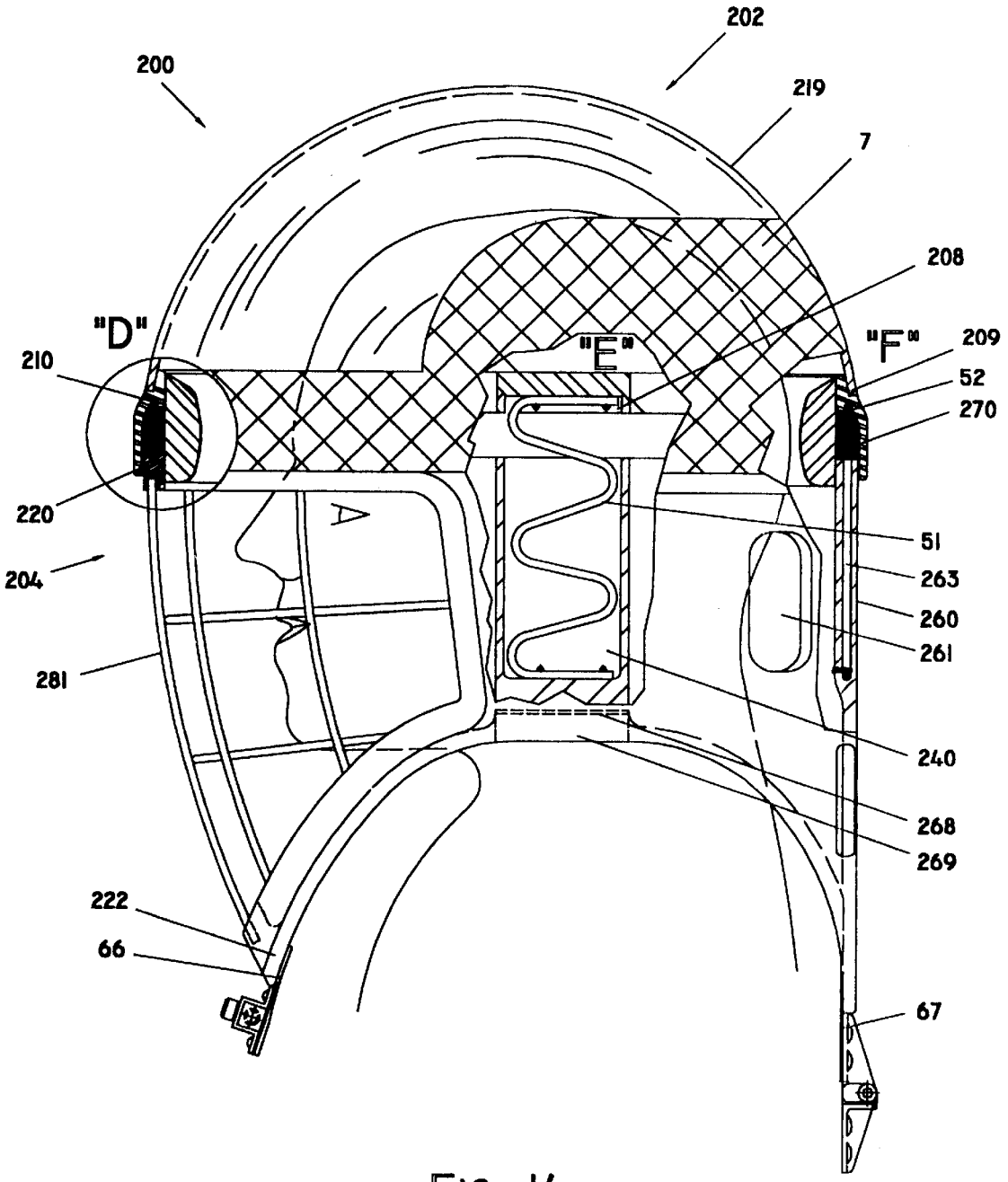
FIG. 14 is a fragmentary side elevation view of a first alternative embodiment of the shoulder pad mounted protective head cage assembly, with details "D," "E," "F" indicated.
Figure 15:
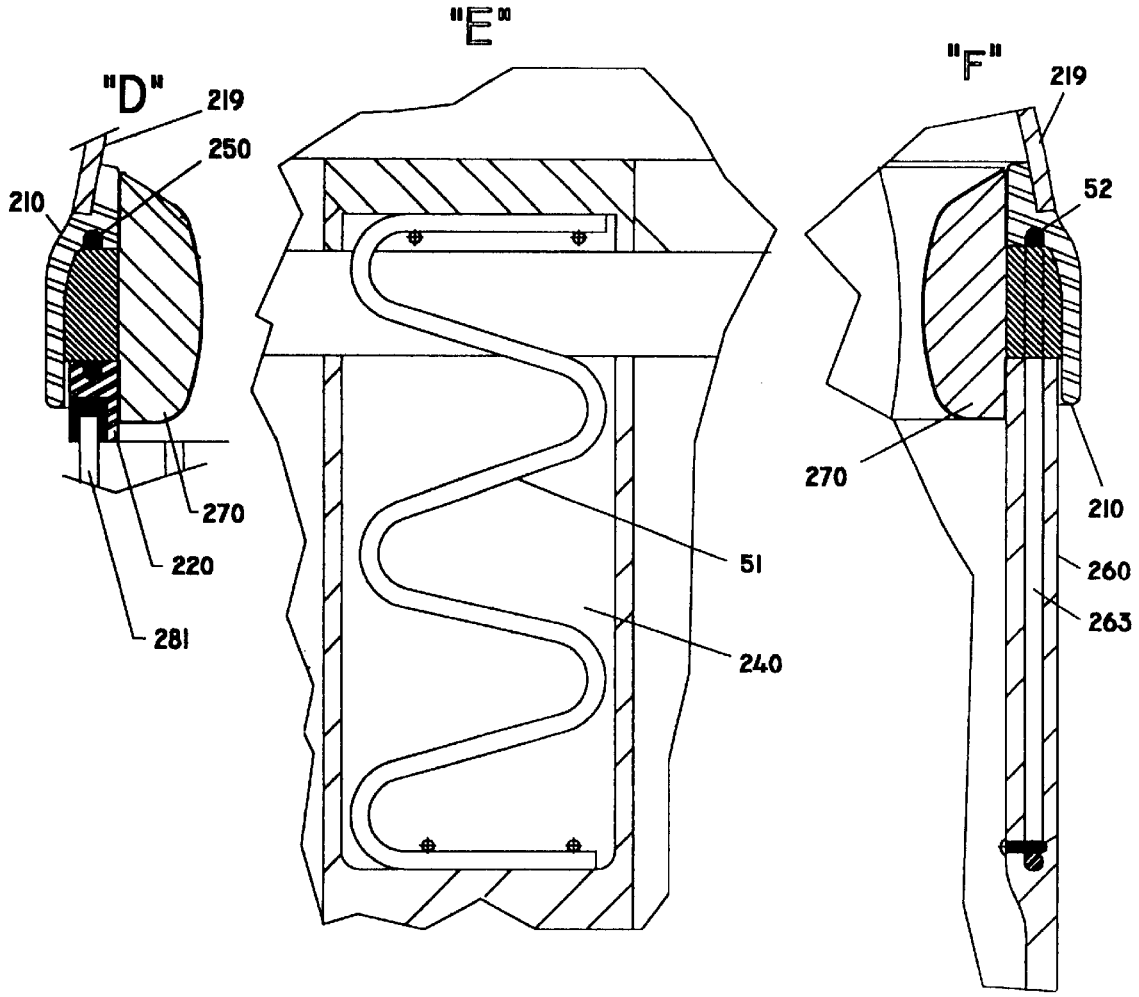
FIG. 15 shows enlarged view of details "D," "E" and "F" of FIG. 14.
Figure 16:
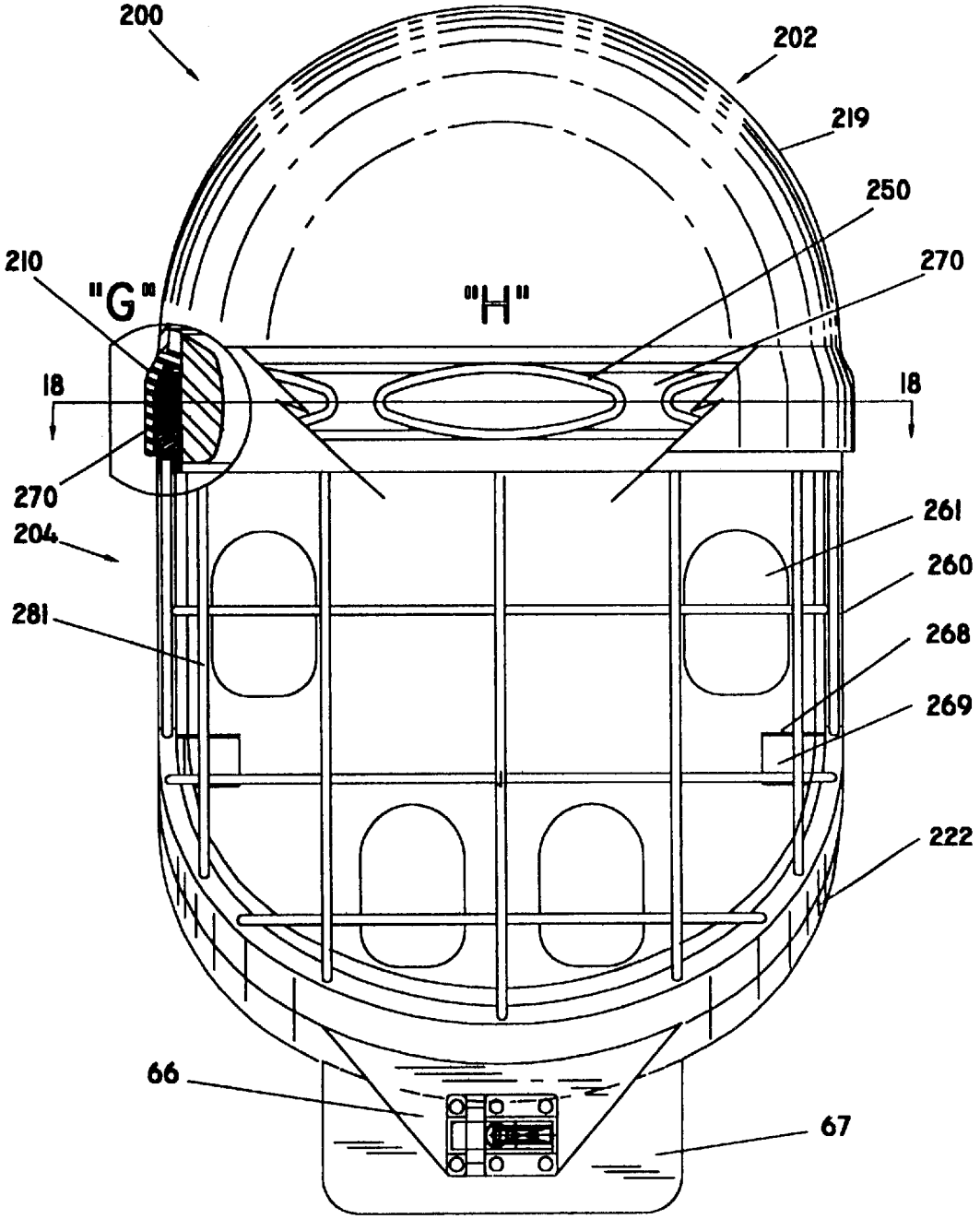
FIG. 16 is a fragmentary front elevational view of the protective head cage shown in FIG. 14, and shows a different kind of vertical shock absorbing spring, with details "G" and "H" indicated, and a different kind of front latch.
Figure 17:
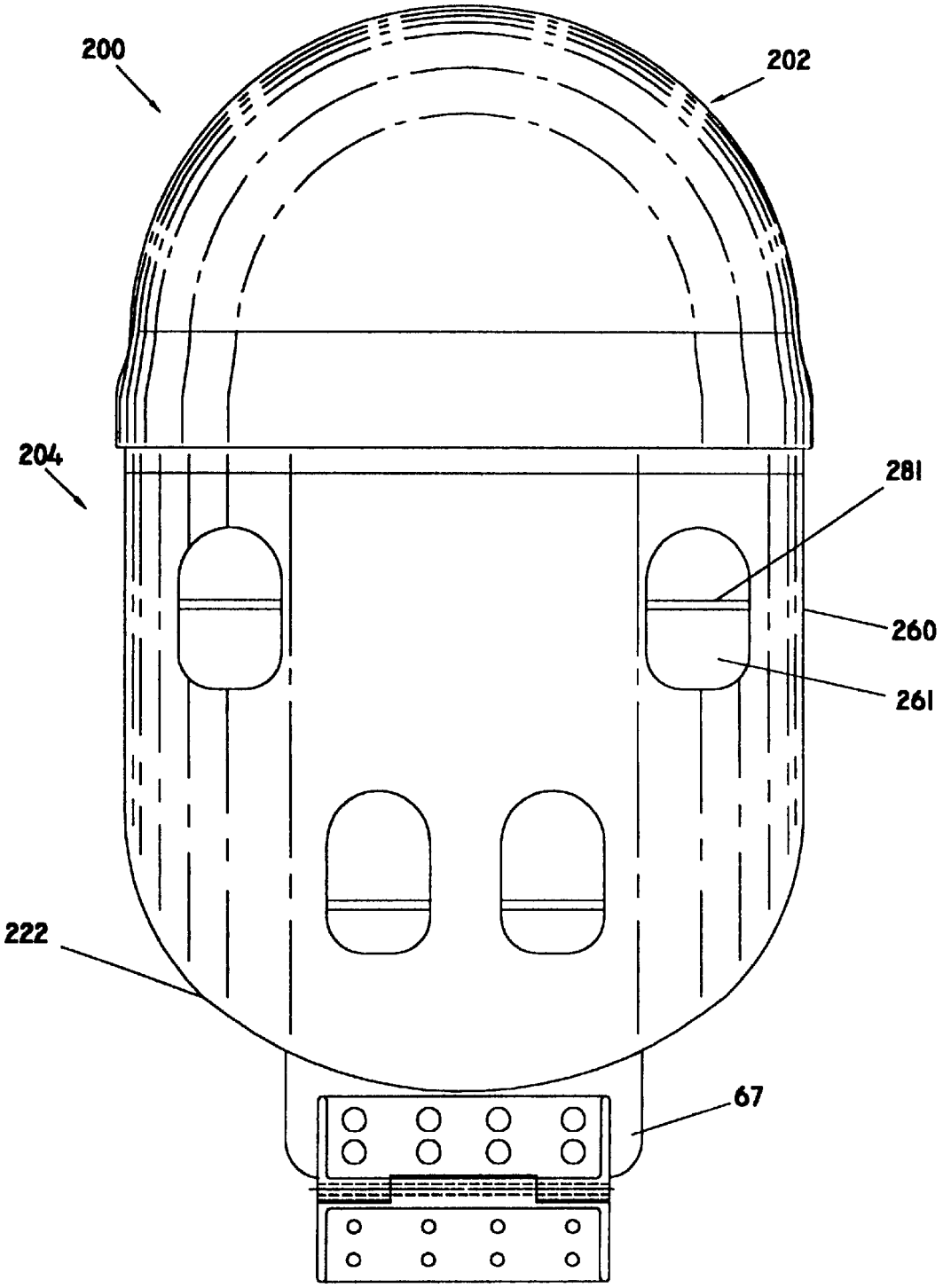
FIG. 17 is a back elevation view of the protective head cage shown in FIG. 14, and shows a different kind of back hinge.
Figure 19:
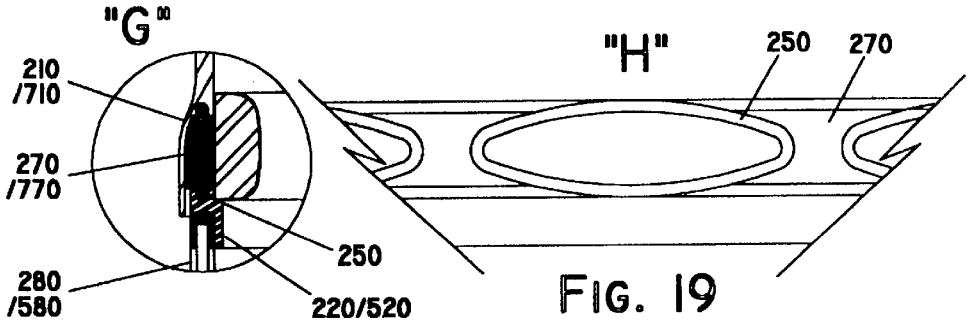
FIG. 19 shows enlarged views of details "G" and "H" of FIG. 16.

The shock absorbing horizontal springs 250 are preferably of elliptical shape as shown in FIGS. 16 and 19. Pockets 240 on each side and the pocket 263 in the back on the inside surface of the lower support structure for holding the shock absorbing vertical springs 51 and 52, respectively, as shown in FIGS. 14 and 15. The energy absorbing annular band 270 is preferably constructed of compression formed closed cell foam of two different densities, with the higher density foam being of a shore durometer of 50 to 60 and the lower density foam being of a shore durometer of 30 to 40 and would be configured to fit within the horizontal springs 250 and the vertical springs 51 at the sides and 52 in the back as shown in details "D," "E" and "F" of FIG. 15. A cover of ETC fabric is bonded to the inner portion of the annular band 270. The annular band 270 is adhesively bonded to the bottom surface of the ring 210 at the bottom of the crown structure and to the top surface of the ring 220 at the top of the lower structure. The shock absorbing vertical springs 51 at the sides and 52 in the back, is retained with escutcheon pins as shown in detail "E" and "F" in FIG. 15. Openings 261 are defined in the back of the vertical panel 260 for air passage through the protective head cage as shown in FIGS. 14 and 16. Small steel panels 66 and 67 are also rigidly attached at the front for mounting a latching means and at the back for mounting a hinge means, respectively.

The unique feature of this construction is the use of the compression formed foam within the shock absorbing horizontal springs to assist in control of the vertical shock absorbing characteristics, especially in the higher weight range of over 200 pounds of persons wearing the protective head cage assembly.

A second alternate embodiment of a shoulder pad mounted protective head cage assembly 300 is shown in FIGS. 20 through 23. The second alternative embodiment is preferably constructed of fiberglass/graphite random and unidirection fiber composite plastic as previously described for the protective head cage assembly 200 shown in FIGS. 14 through 17. The new innovation in this construction is the use of a two different density closed cell foam laminate annular band that eliminates the use of shock absorbing horizontal springs 250 and is used in combination with the shock absorbing vertical springs 51 and 52 in two different configurations and in a third configuration, as the only shock absorbing means.

Figure 20:
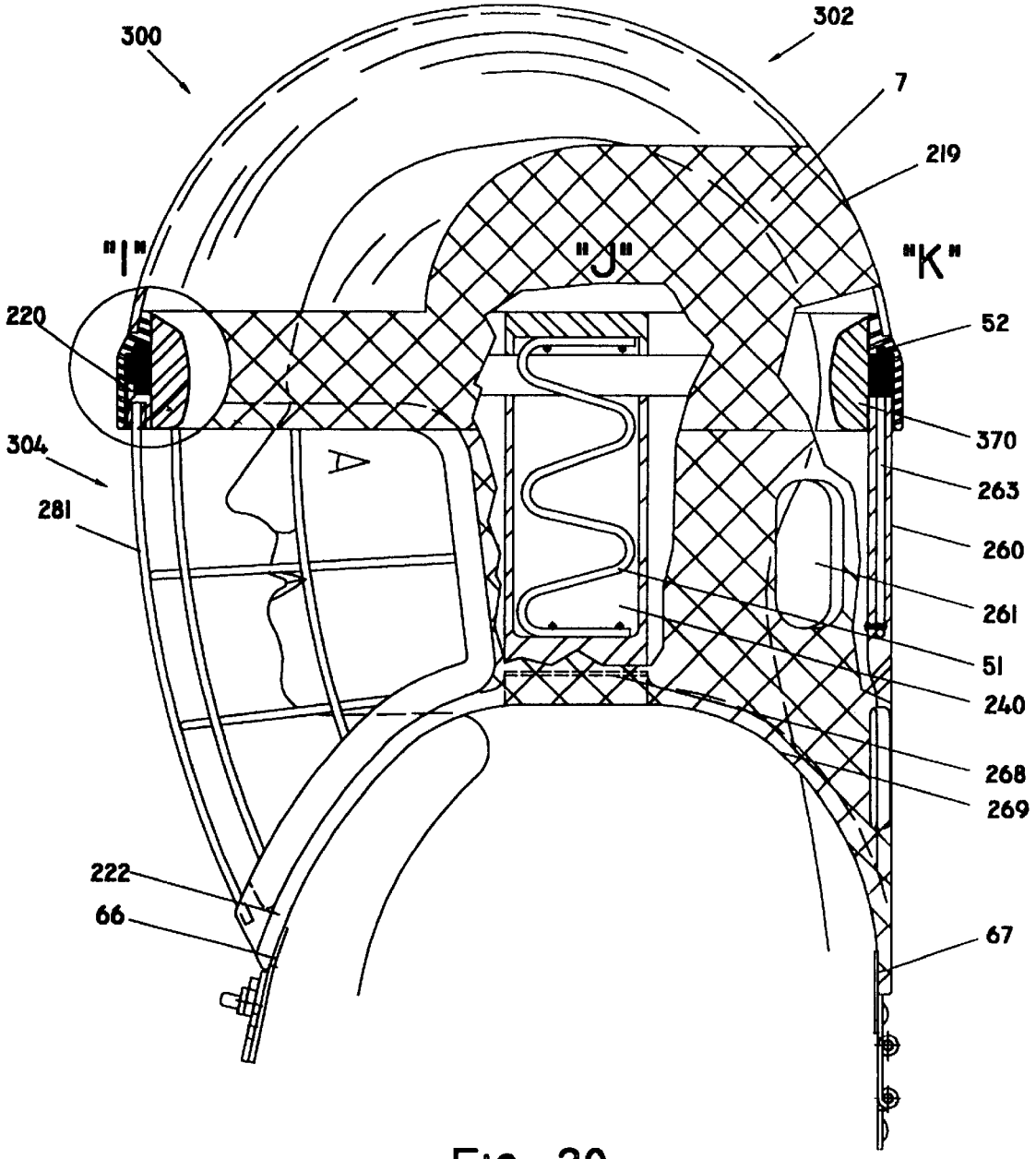
FIG. 20 is a fragmentary side elevation view of a second alternative embodiment of a shoulder pad mounted protective head cage assembly, with details "I," "J" and "K" indicated.
Figure 21:
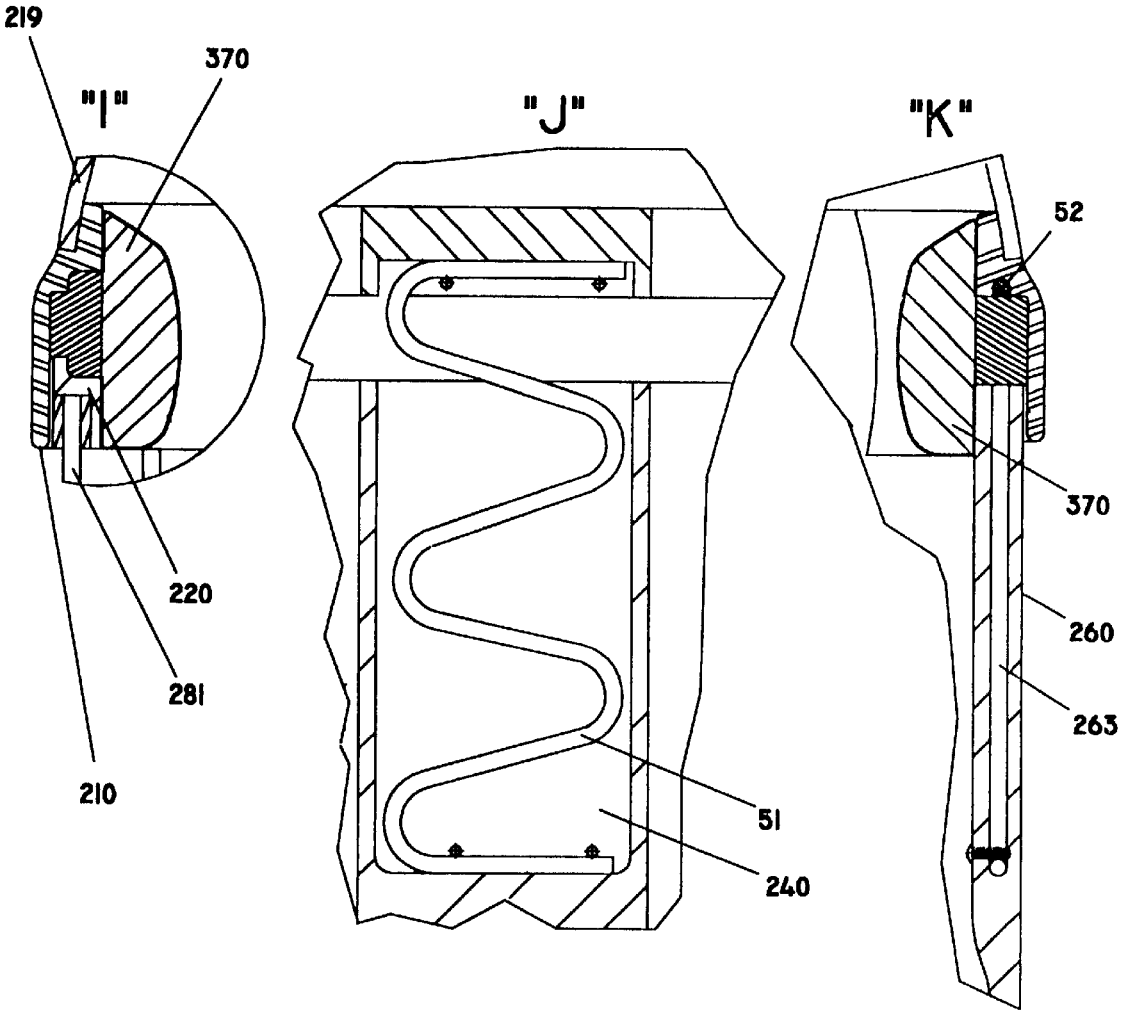
FIG. 21 shows enlarged cross section views of details "I," "J" and "K" of FIG. 20.

As shown in FIG. 20, the energy absorbing annular band 370 is configured to fill the area of about one inch vertically and three-eighths of an inch horizontally between the bottom of the crown structure and the top of the lower support structure and is adhesively bonded to those surfaces. This portion of the annular band is of a closed cell foam of a shore durometer of 50 to 60. A lower density closed cell foam of a shore durometer of 30 to 40 is compression formed to the configuration shown in cross section as Detail "I" of FIGS. 20 and 21.

Figure 22:
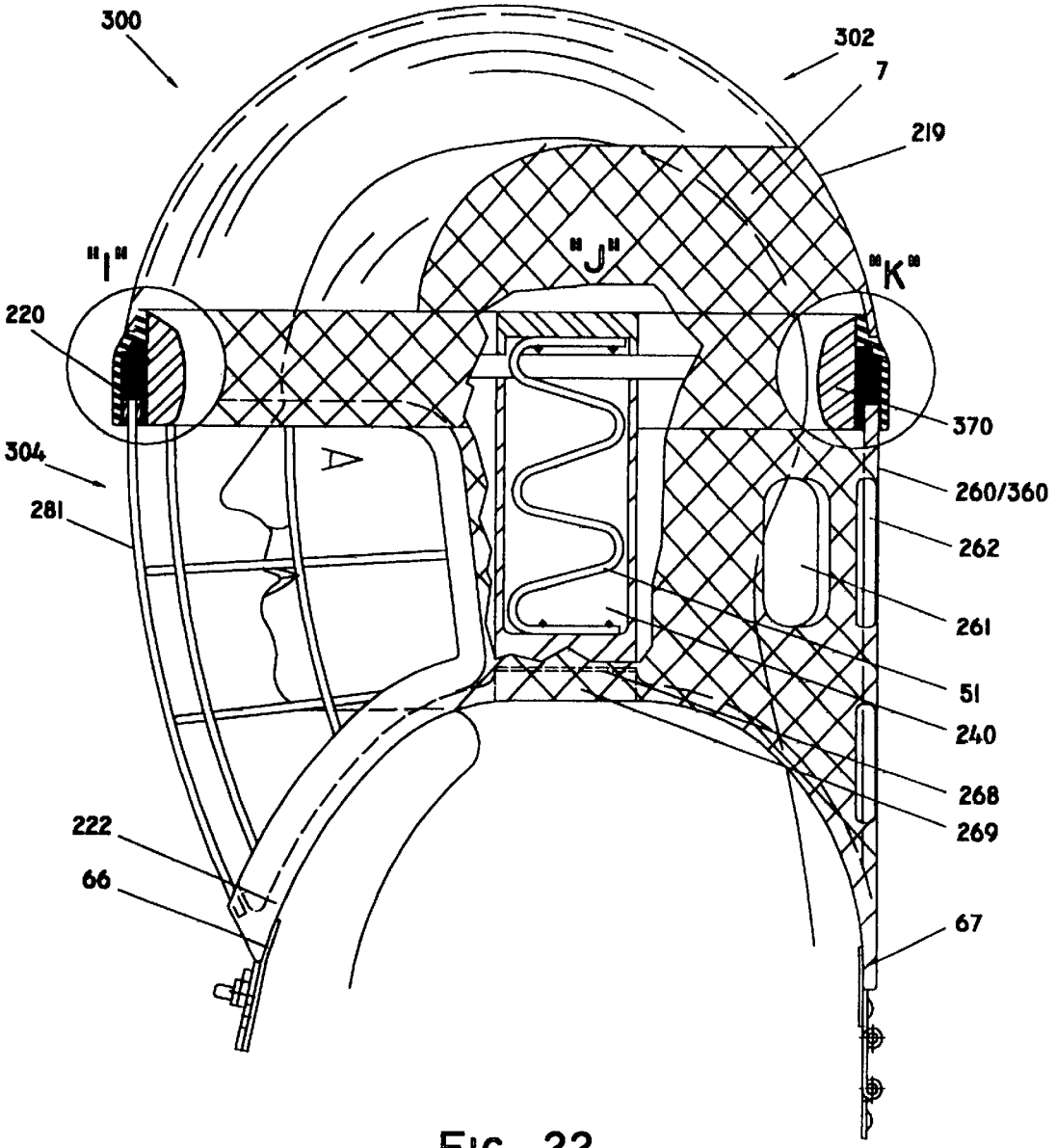
FIG. 22 is a fragmentary side elevation view of a different configuration of the protective head cage assembly shown in FIG. 20.
Figure 23:
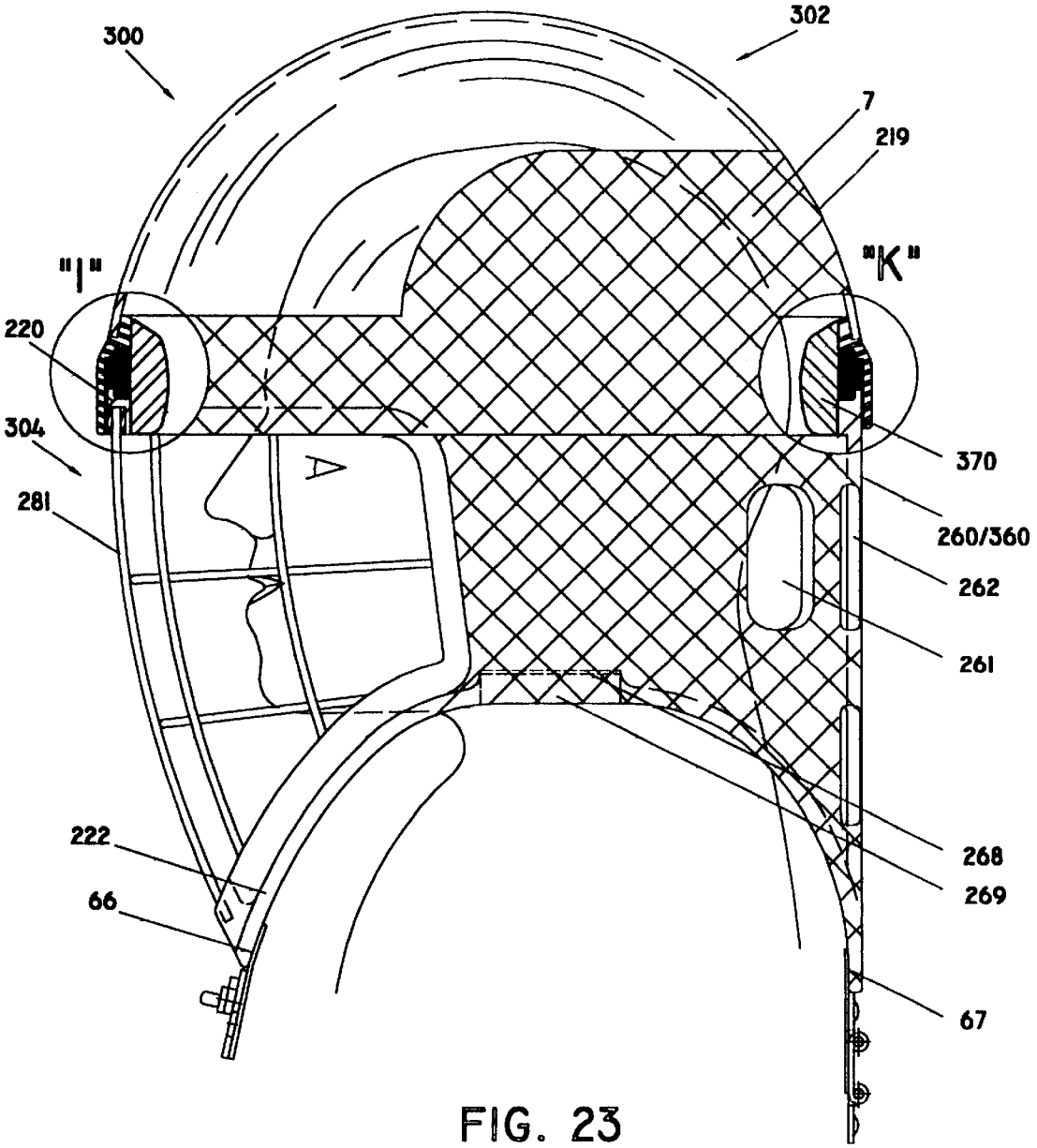
FIG. 23 is a fragmentary side elevation view of the protective head cage assembly of FIG. 20.

For persons in the weight range of 150 to 200 pounds, the shoulder mounted protective head cage assembly would be as shown in FIG. 20. In this configuration, the energy absorbing annular band 370 would be used in combination with shock absorbing vertical springs 51 at the sides and 52 in the back. For persons in the weight range of 125 pounds to 150 pounds, the shoulder mounted protective head cage assembly would be as shown in FIG. 22. In this configuration, the energy absorbing annular band 370 would be used in combination with shock absorbing vertical springs 51 on the sides. As no shock absorbing vertical springs are used in the back, the pockets on the inside surface of the vertical panel of the lower support structure can be eliminated and additional vent holes 262 added at the center in the back. For persons in the weight range of 75 pounds to 125 pounds, the shoulder mounted protective head cage would be assembled as shown in FIG. 23. In this configuration, the energy absorbing annular band 370 would be the only vertical shock absorbing means within the protective head cage assembly. Also, in this configuration, as there are no shock absorbing vertical springs used, the pockets on the inside surface of the vertical panel of the lower support structure can be eliminated and additional vent holes 262 located in the center in the back.

Figure 24:
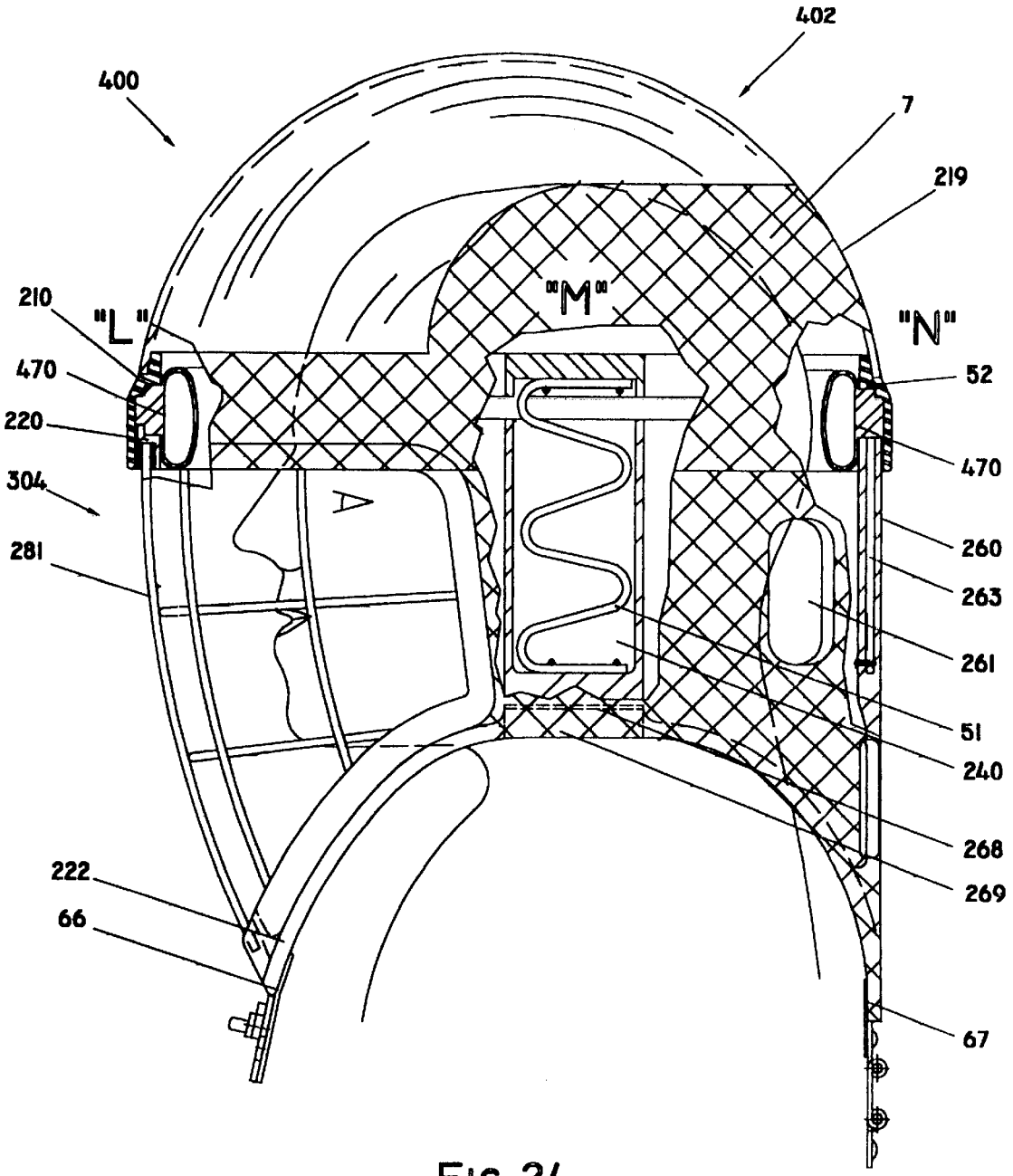
FIG. 24 is a fragmentary side elevation view of a third alternative embodiment of the protective head cage assembly, with details "L," "M" and "N" indicated.
Figure 25:
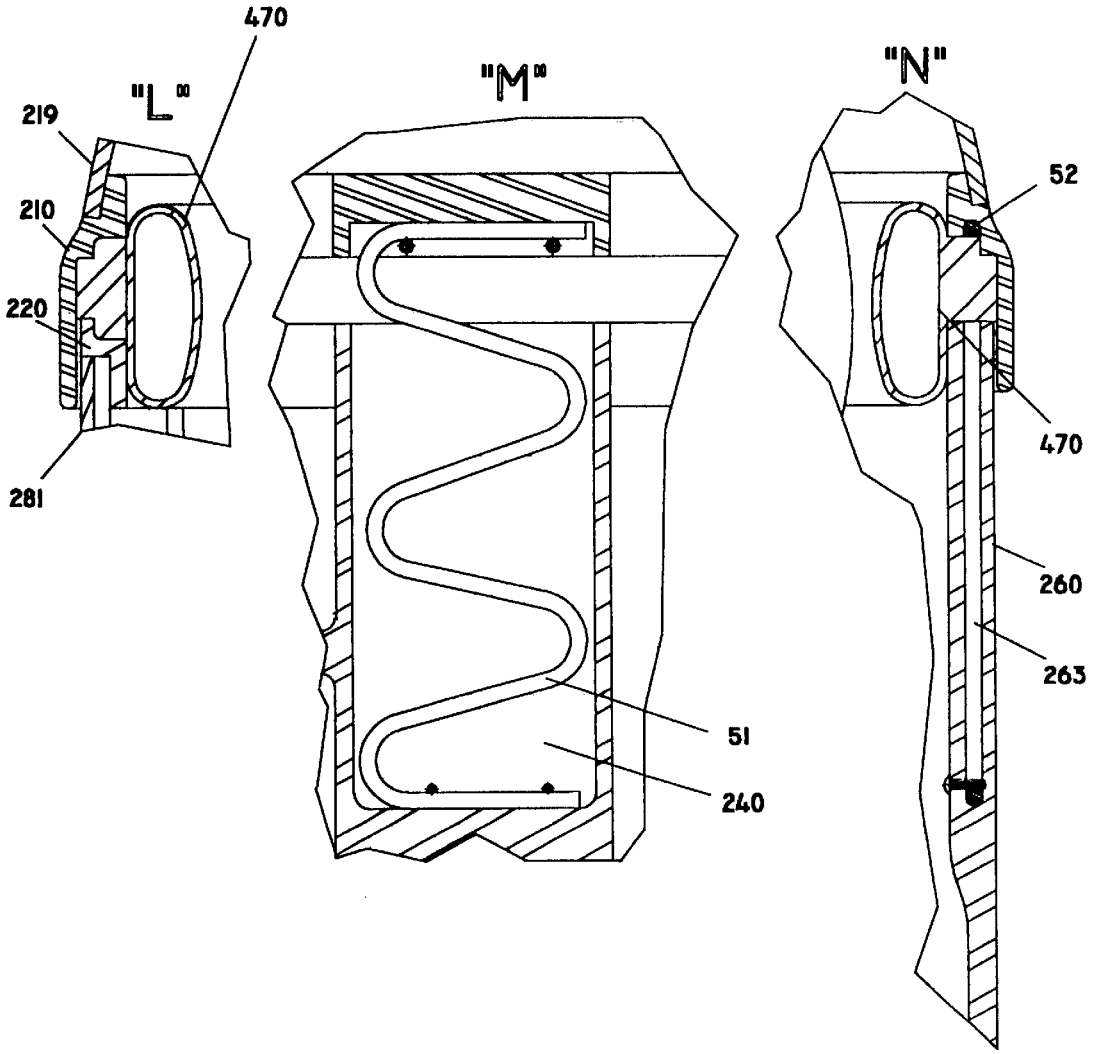
FIG. 25 shows in enlarged cross section views the details "L," "M" and "N" of FIG. 24.

A third alternate embodiment of a shoulder mounted protective head cage assembly 400 is shown in FIGS. 24 and 25. In this third alternative embodiment, the shock absorbing element 470 joining the crown structure to the lower support structure is a compression formed outer portion over which is a rotational molded a hollow inner portion of a yieldable resilient material, and is preferably a vinyl plastisol. The outer portion, as shown in FIG. 25, fills the area between the recess in the bottom of the ring 210 at the bottom of the crown structure and the corresponding recess in the top of the ring 220 at the top of the bottom structure and is in surface-to-surface contact with the flange of the crown structure that depends in a horizontal spaced relation to the top of the lower support structure when the two structures are joined in assembly.

A fabric of the trade name ETC is used to cover the surface of the hollow portion. A valve for inflating the hollow portion is mounted on the bottom surface at one side. Design considerations incorporating various combinations of durometers and elasticity can be readily employed in the flange to obtain the desired degree of vertical shock absorption to adapt the shoulder mounted protective head cage to a specific application.

Figure 26:
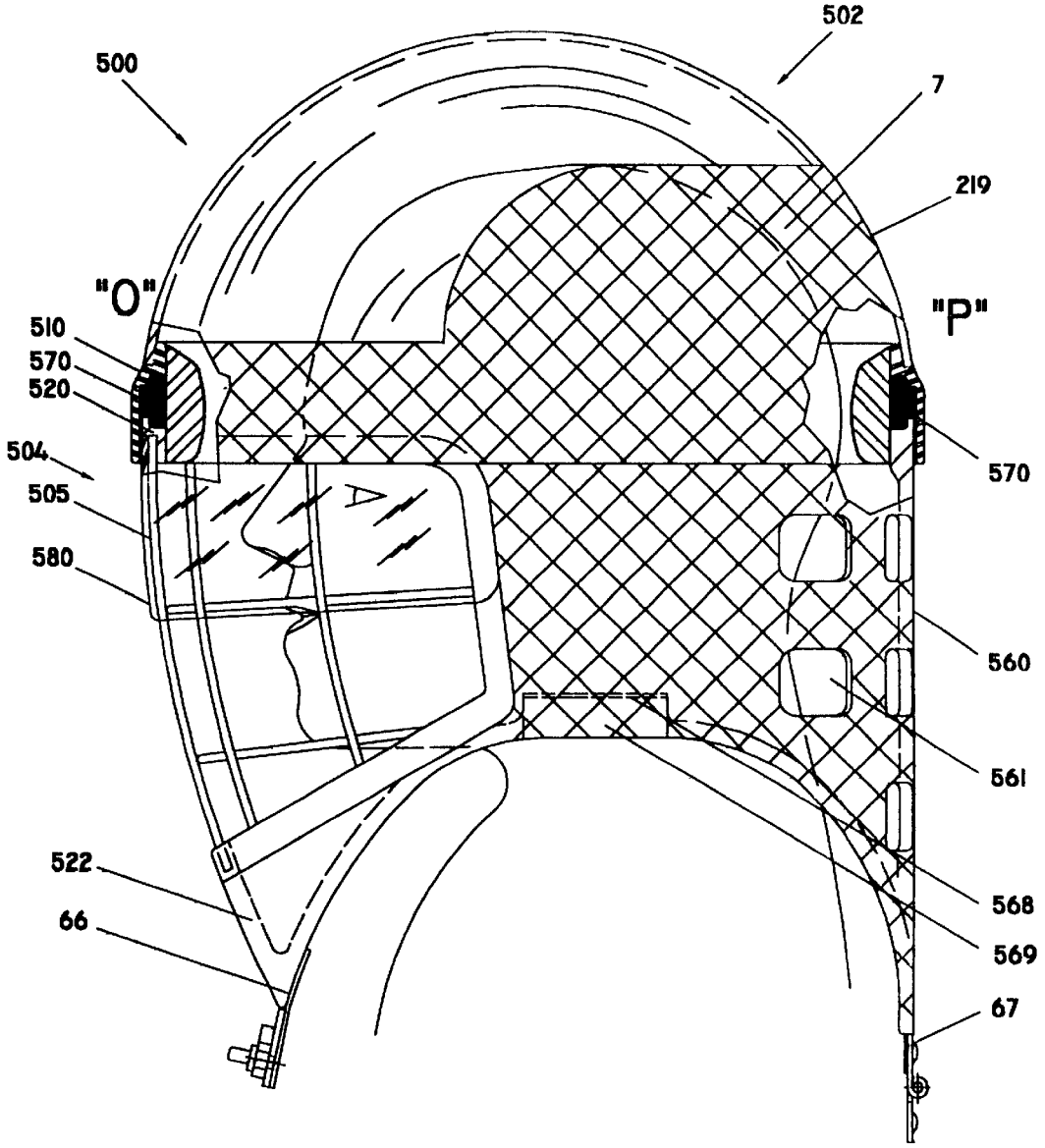
FIG. 26 is a fragmentary side elevation view on a fourth alternative embodiment for a shoulder pad mounted protective head cage assembly with details "O" and "P" indicated.
Figure 27:
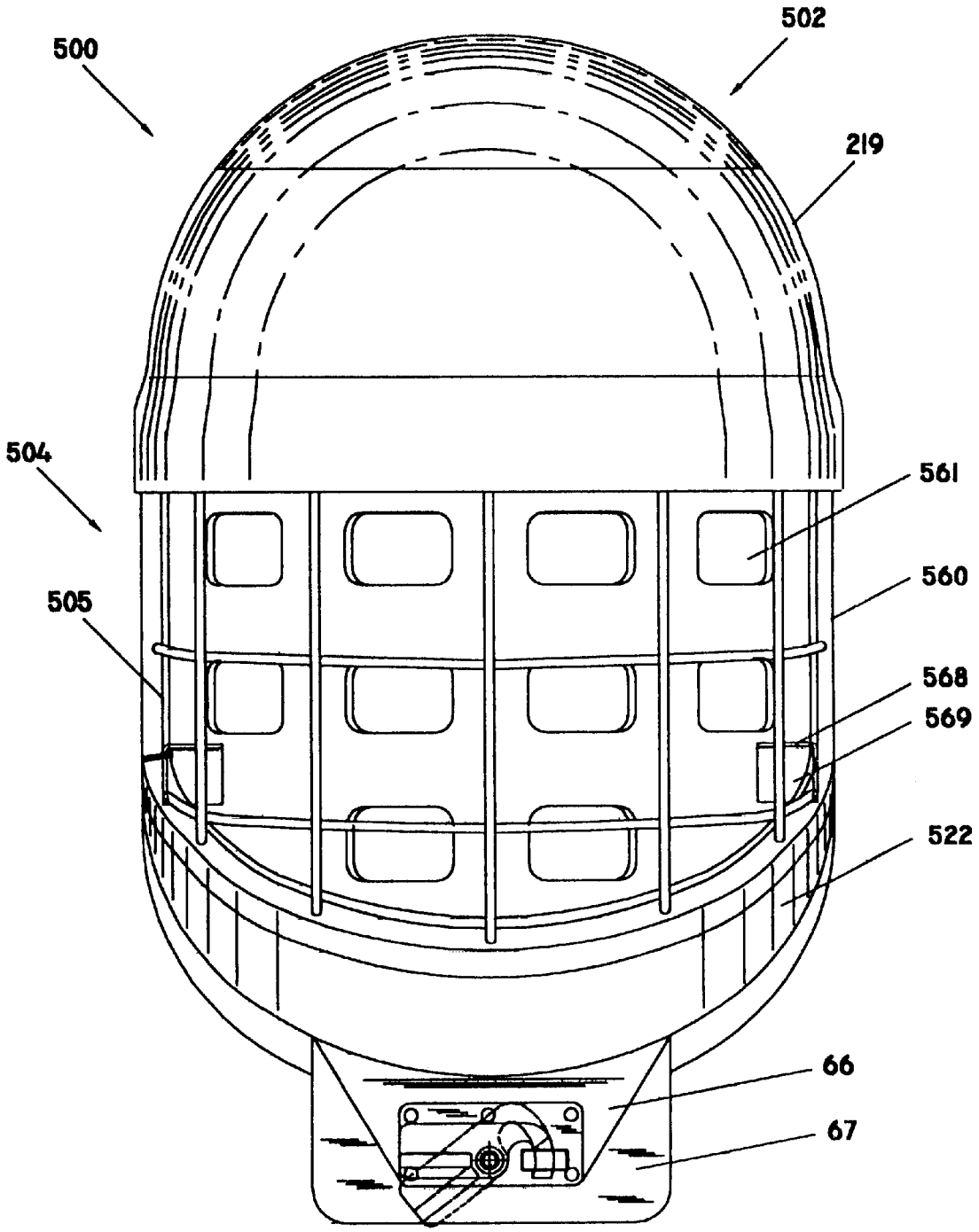
FIG. 27 is a front elevation view of the protective head cage assembly shown in FIG. 26, with a different kind of front latch.
Figure 28:
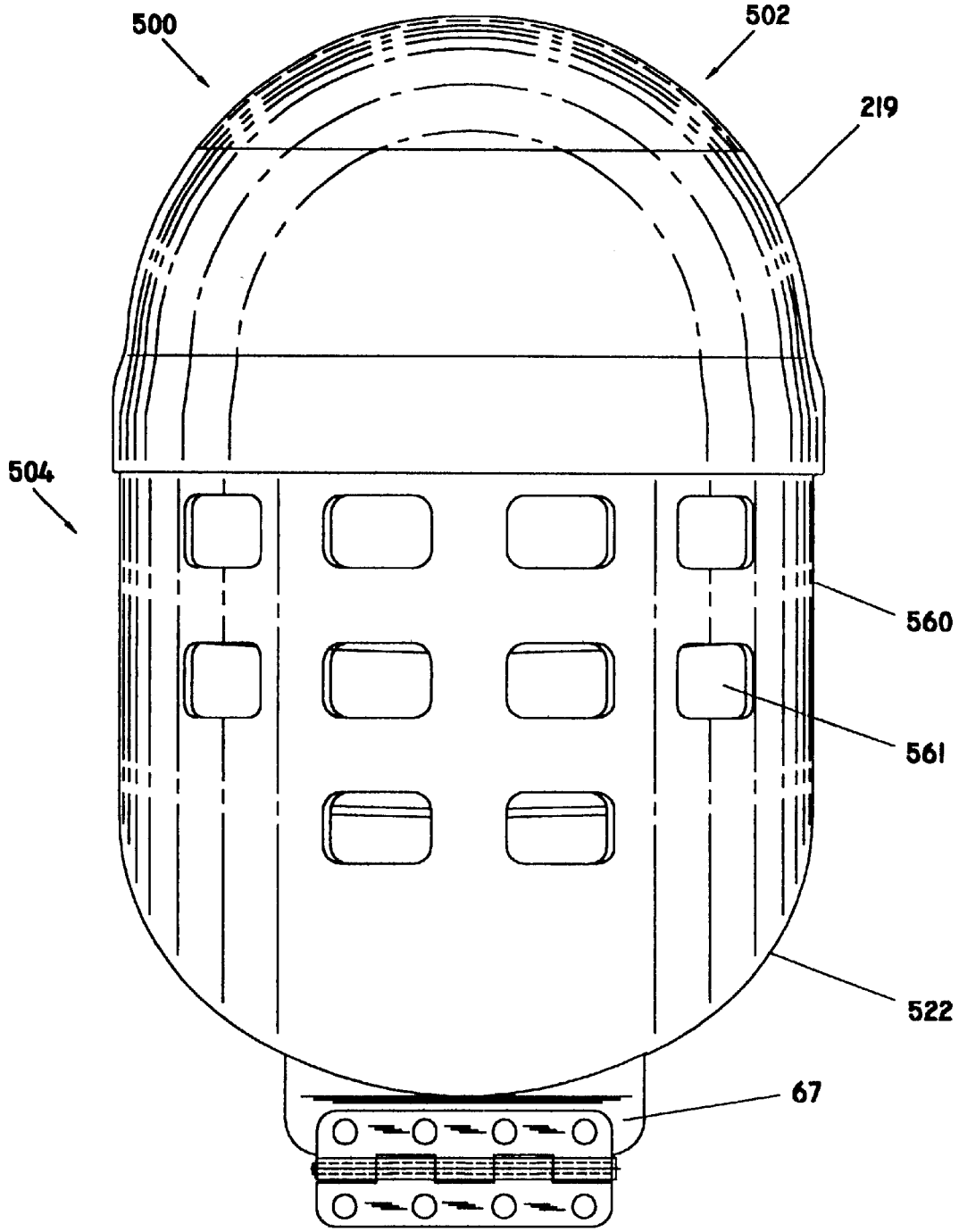
FIG. 28 is a back elevation view of the protective head cage assembly shown in FIG. 26, with a different kind of back hinge.

A fourth alternate embodiment of a shoulder mounted protective head cage assembly 500 suitable for younger persons in the weight range of 75 pounds to 125 pounds is shown in FIGS. 26 through 28. The basic configuration of the crown and lower support structure is as shown in FIG. 26, but these structures could be injection molded of polycarbonate or high impact ABS plastic (a polymer blend of acrylonitrile-butadiene-styrene) or be compression formed of fiberglass/graphite random and unidirectional fiber composite plastic. A laminate of two different densities of closed cell foam that are compression formed into an energy absorbing annular band 570, having a fabric under the trade name ETC is preferably used to join the two structures together on the inside surface. The unique feature of this construction is the opening at the front portion of the lower support structure for an interchangeable vertical load bearing frame in which either an open grid type face guard or a dual wall transparent face shield can be mounted. This feature allows a single shoulder mounted protective head cage assembly to be used for football or hockey.

Referring now to FIG. 26, shown is a side elevation view of this shoulder mounted head cage with an open grid-type face guard 505. The basic construction for the crown structure is the same as that previously described for the shoulder mounted head cage 300 shown in FIG. 22. The lower support structure would also be the same except that there is a vertical portion at the front that extends upward to a point about midway between a horizontal plane at the apex of the shoulder area and the bottom of the lower support structure.

The annular band 570 is adhesively bonded to the bottom surface of the crown structure and to the top of the lower support structure and is the only shock absorbing element used.

FIG. 27 is a front elevational view showing the openings 561 in the back surface for air passage through the protective head cage. FIG. 28 is a rear elevation view again showing the air openings 561 in the back that are small enough to prevent the small end of a hockey stick from entering. As with the other previously described shoulder mounted head cage assemblies, this embodiment will comprises adjustable positioning pads 569 in the shoulder areas and panels 66 and 67 at the front and back for mounting a latching means and a hinge means, respectively.

Figure 29:
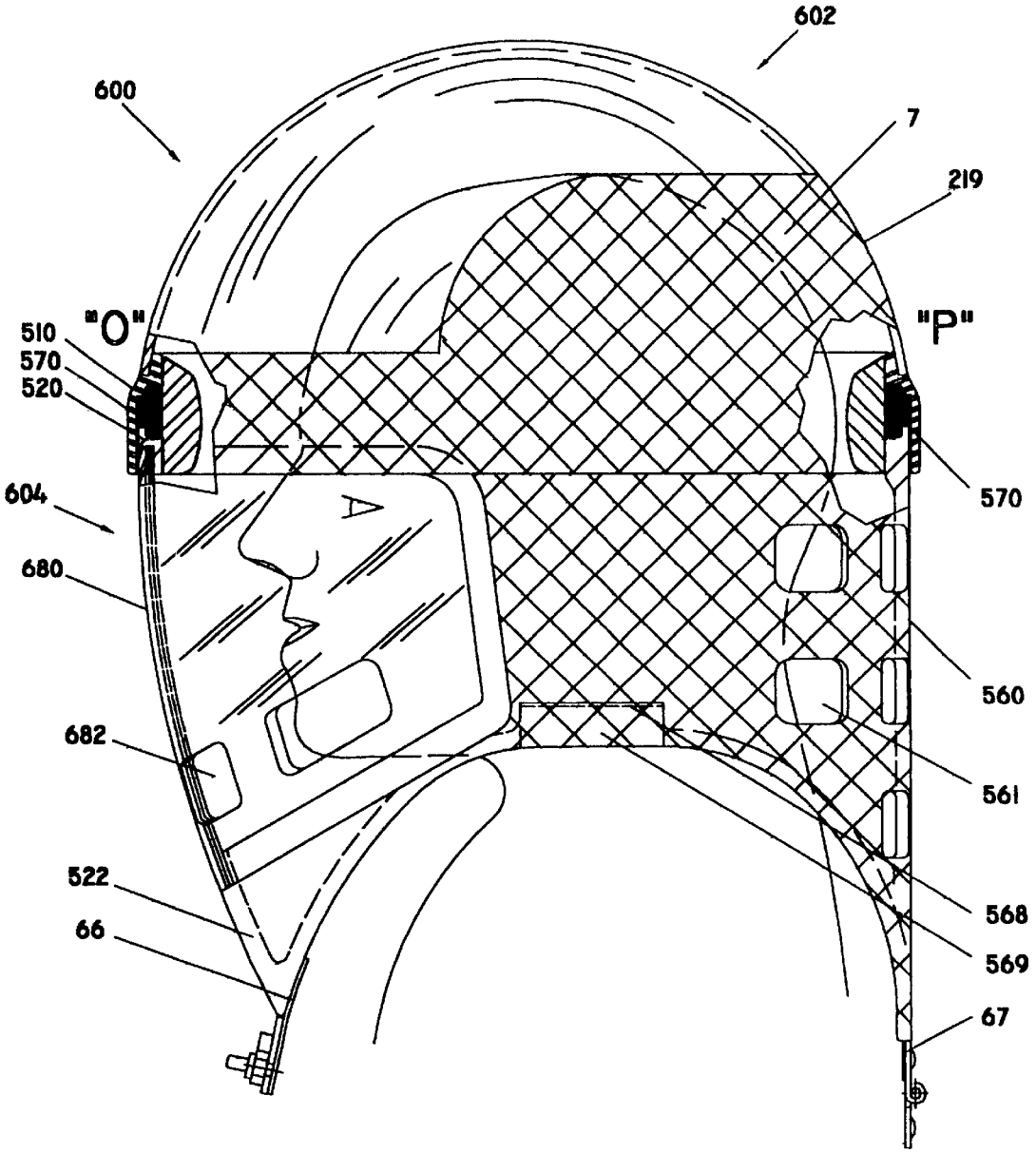
FIG. 29 is a fragmentary side elevation view of a fifth alternative embodiment of the protective head cage assembly shown in FIG. 26 with details "O" and "P" indicated.
Figure 30:
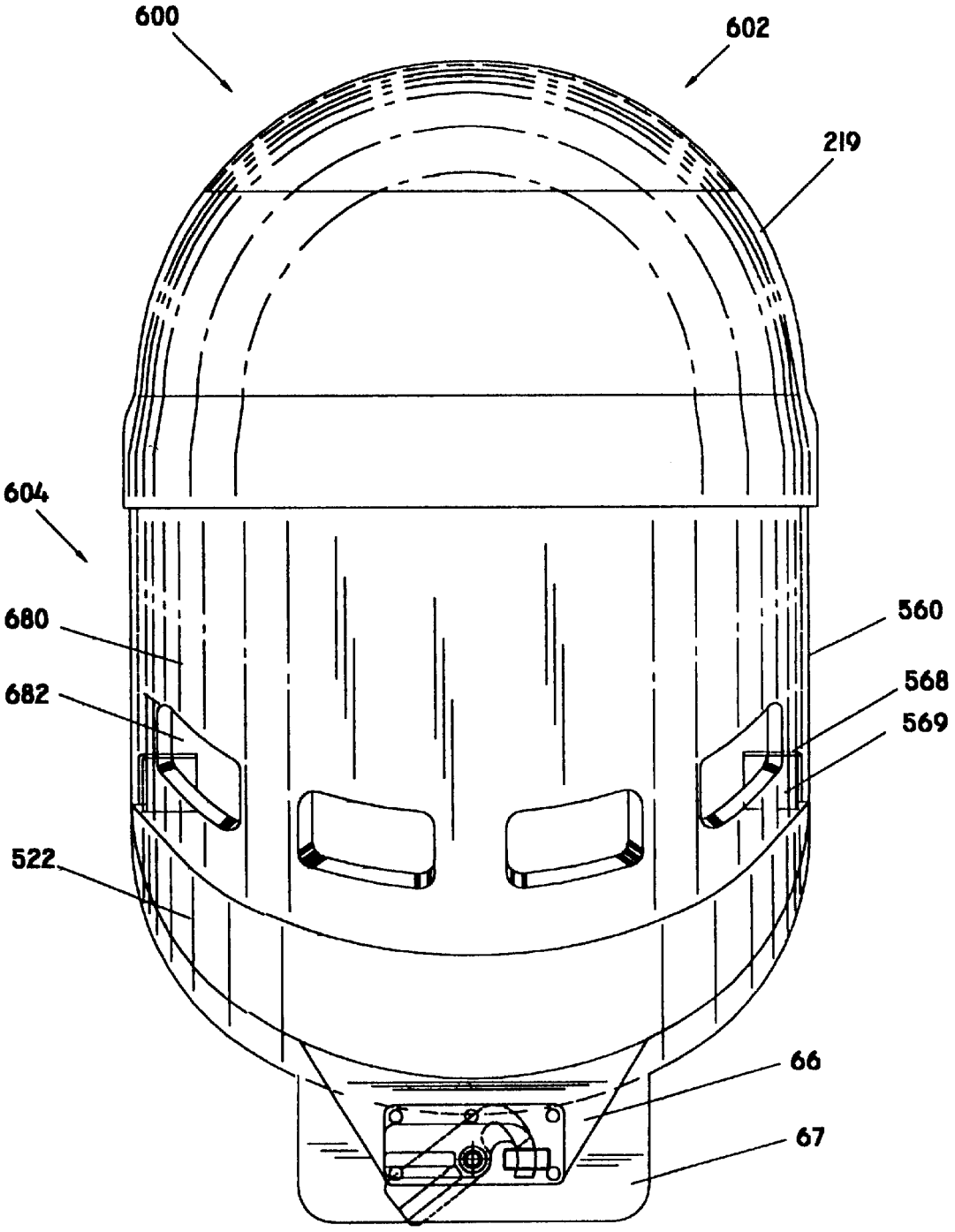
FIG. 30 is a front elevation view of the protective head cage assembly shown in FIG. 29.
Figure 31:
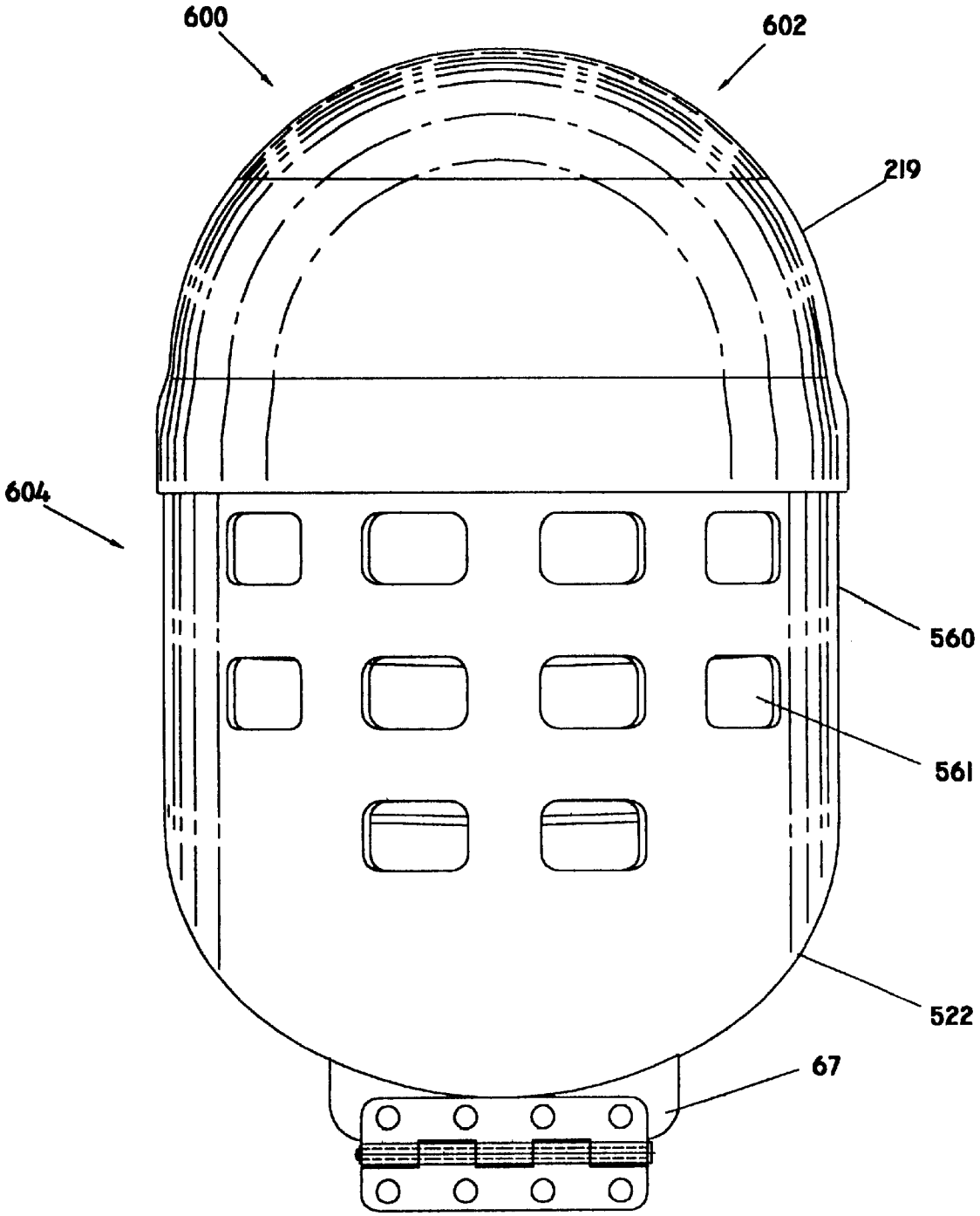
FIG. 31 is a back elevation view of the protective head cage assembly shown in FIG. 29.

A fifth alternate embodiment of the shoulder mounted protective head cage assembly 600 of the previous protective head cage used for football is shown in FIGS. 29, 30 and 31. The fifth embodiment comprises a dual panel transparent polycarbonate face shield 680 for use in the sport of hockey. Rectangular openings 682 are defined in the front of the apparatus as shown in the side view, FIG. 29, and in the front view, FIG. 30. The openings 682 are small enough to prevent entry of the small end of a hockey stick. In the rear view, FIG. 31, there is shown several small openings 561 that provide adequate air passage through the protective head cage assembly. The energy absorbing annular band is the same as the band 570 used in the protective head cage assembly 500.

Figure 18:
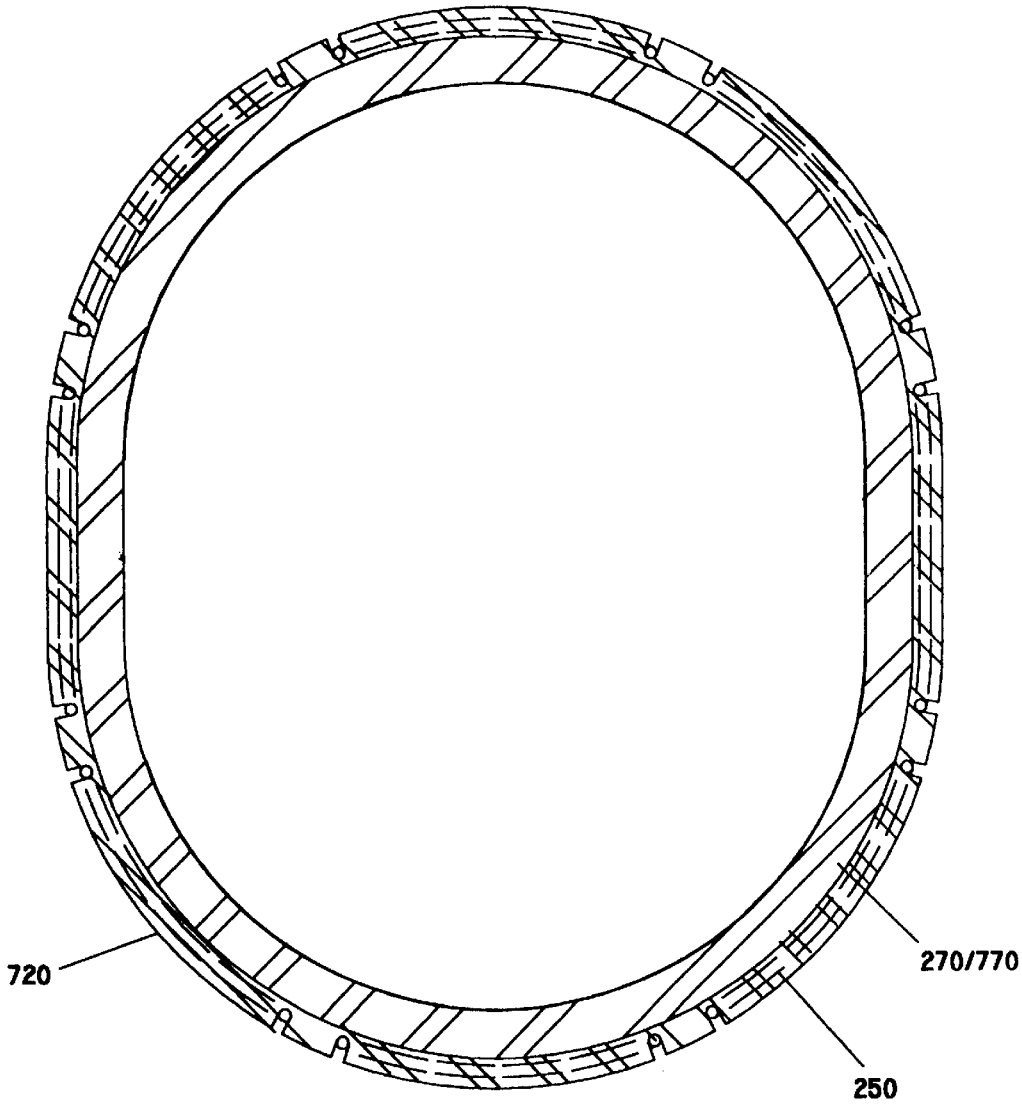
FIG. 18 is a cross section view along line 18—18 of FIG. 16.
Figure 32:
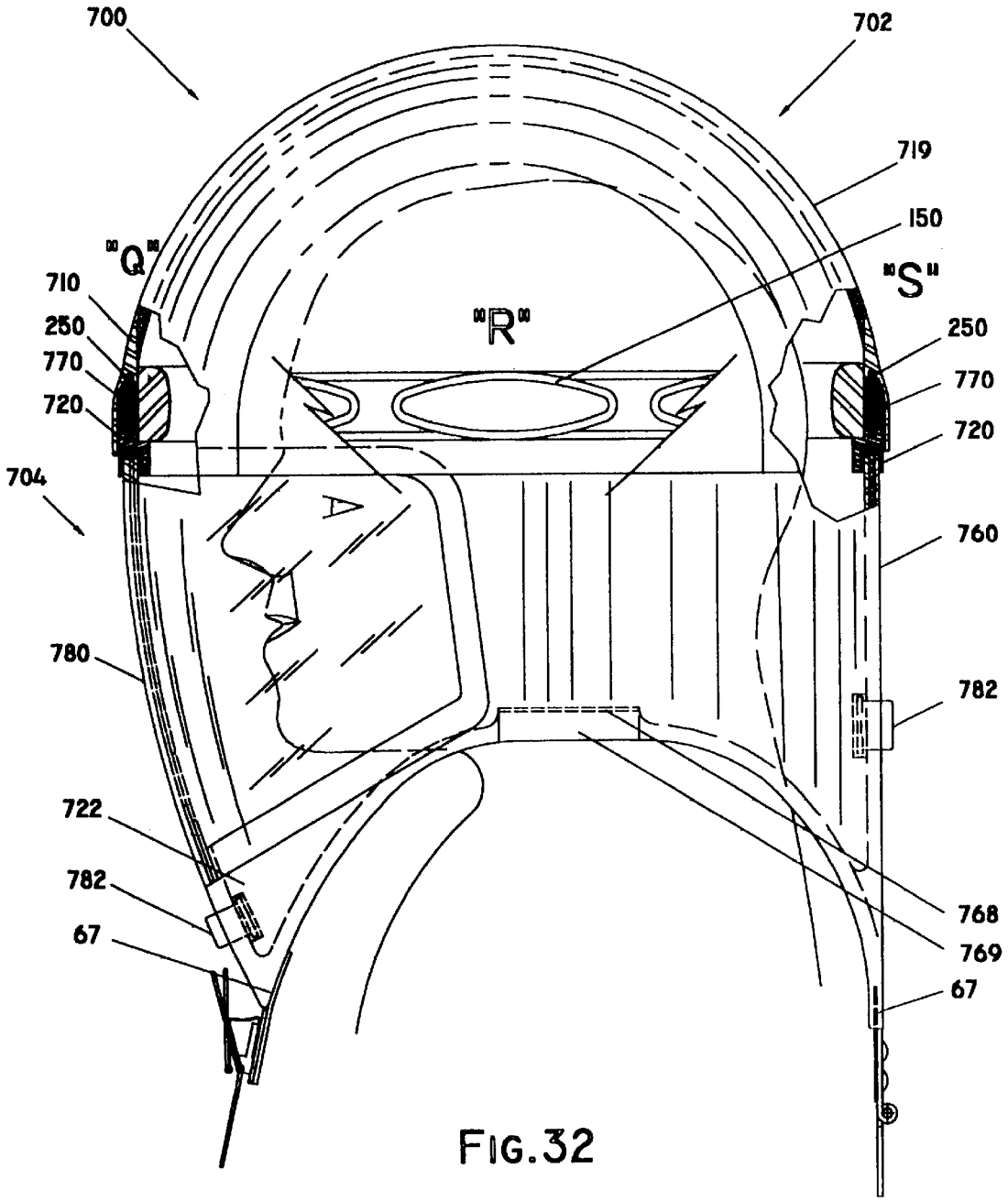
FIG. 32 is a fragmentary side elevation view of a sixth alternative embodiment of a shoulder pad mounted protective head cage assembly with details "Q," "R" and "S" indicated.
Figure 33:
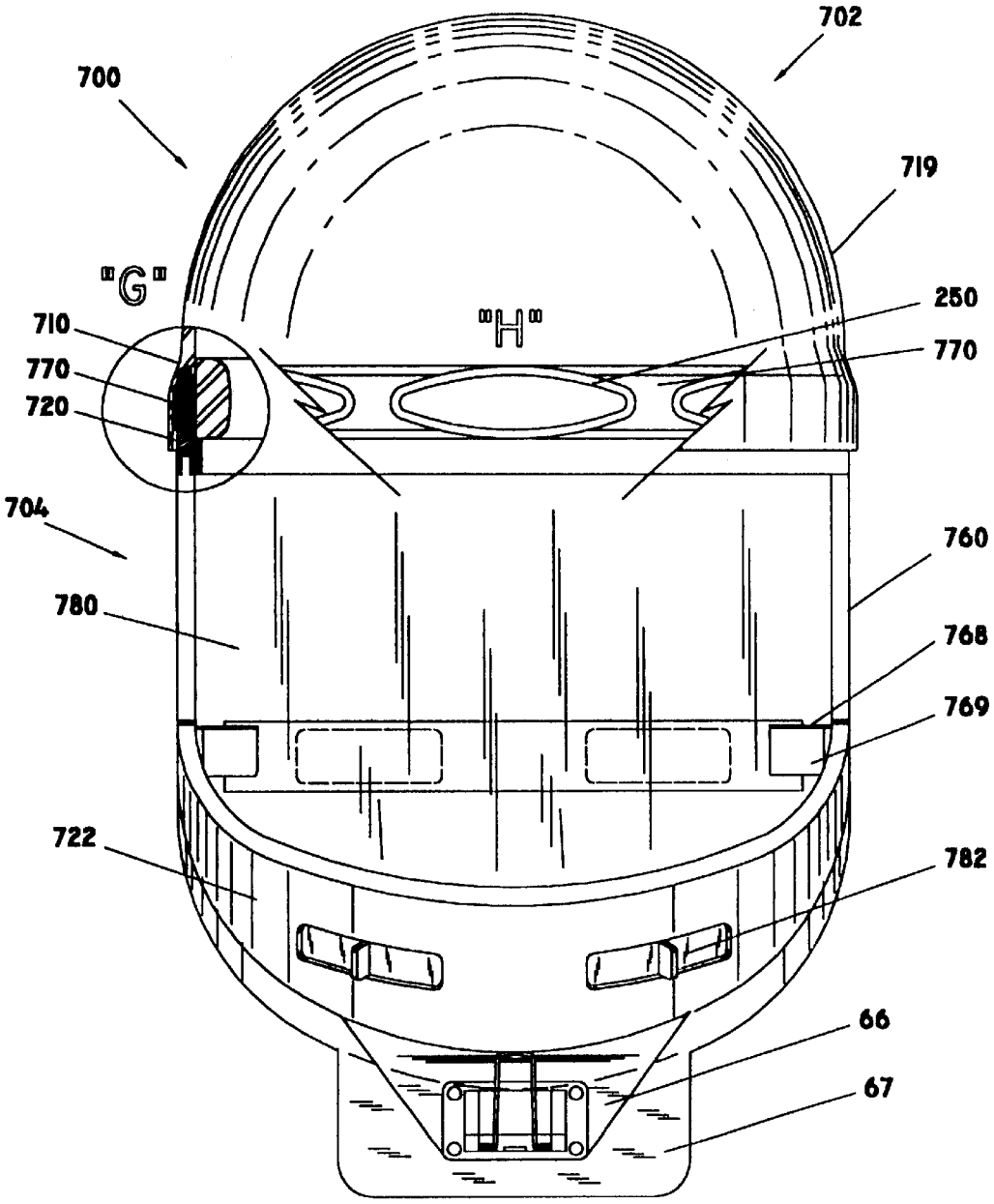
FIG. 33 is a fragmentary front elevation view of the protective head cage assembly shown in FIG. 32, with a different kind of front latch.
Figure 34:
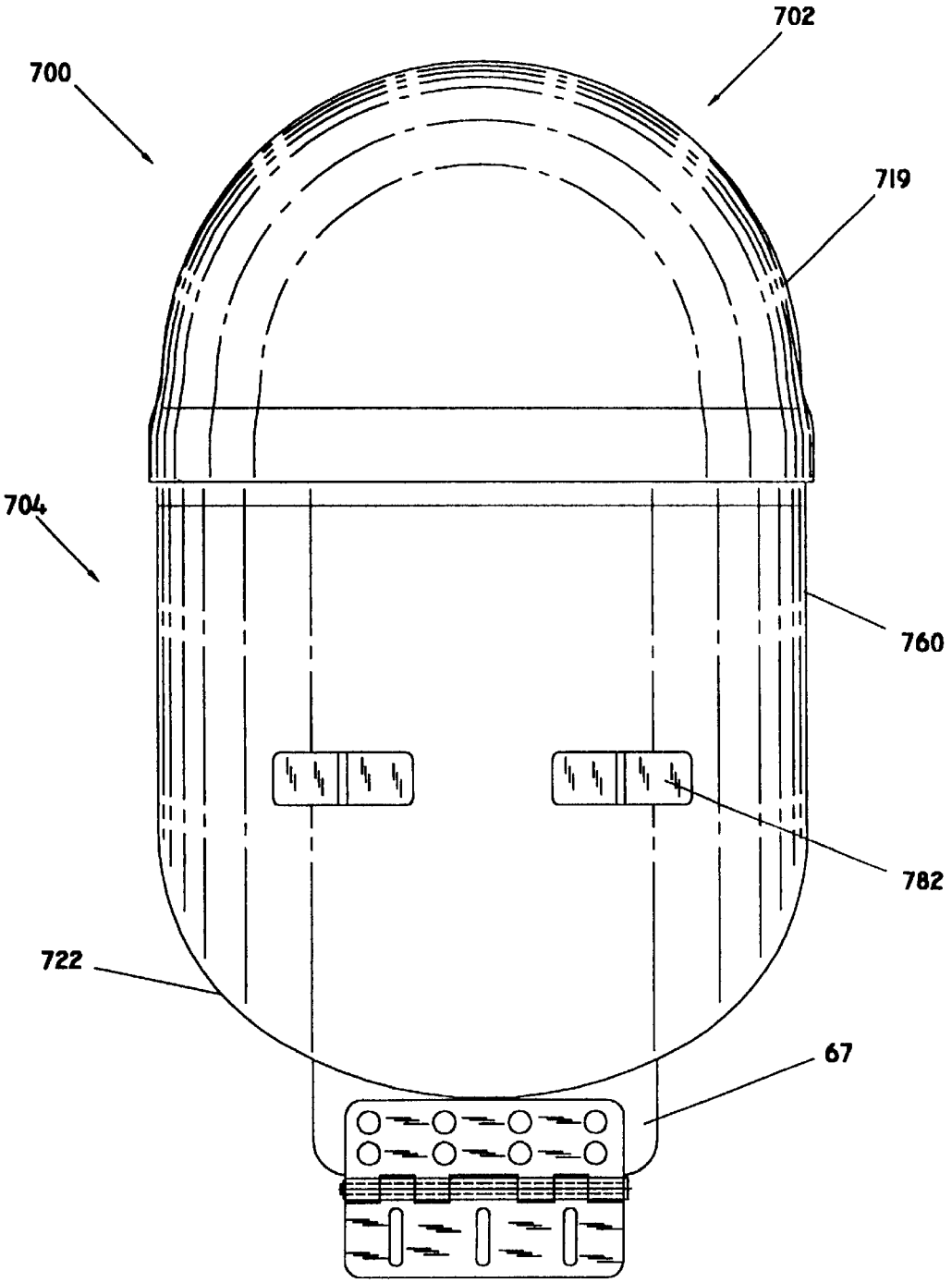
FIG. 34 is a back elevation view of the protective head cage assembly shown in FIG. 32, with a different back hinge.
Figure 35A:
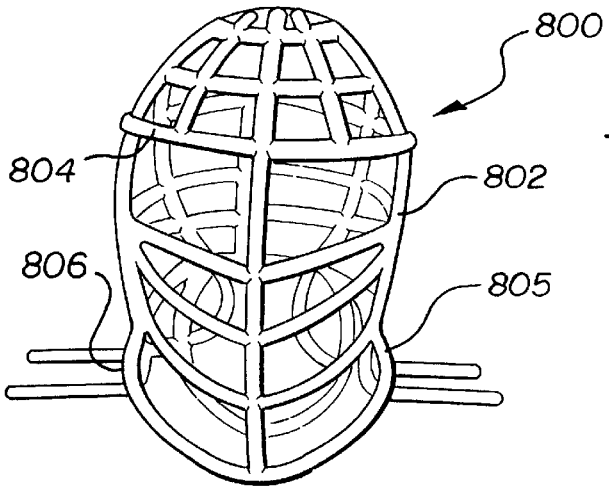
FIG. 35A is a front view of a seventh alternative embodiment of a shoulder pad mounted protective head cage assembly.
Figure 35B:
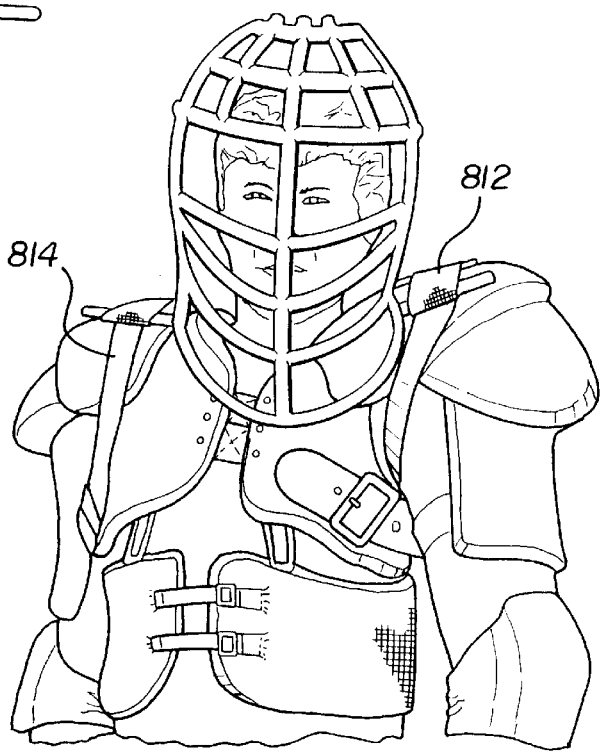
FIG. 35B is front view of the head case assembly of FIG. 35A shown worn by a football player.
Figure 36A:
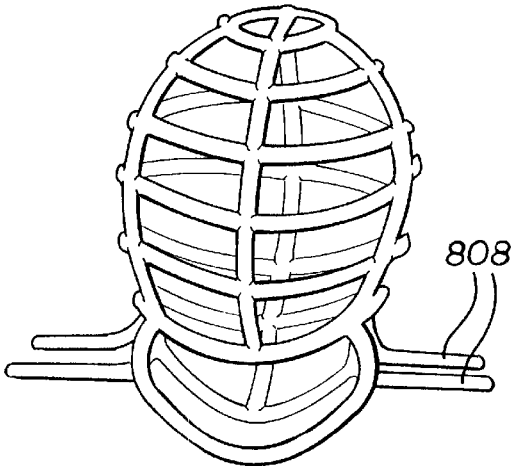
FIG. 36A is a rear view of the shoulder pad mounted protective head cage assembly shown in FIG. 35A.
Figure 36B:
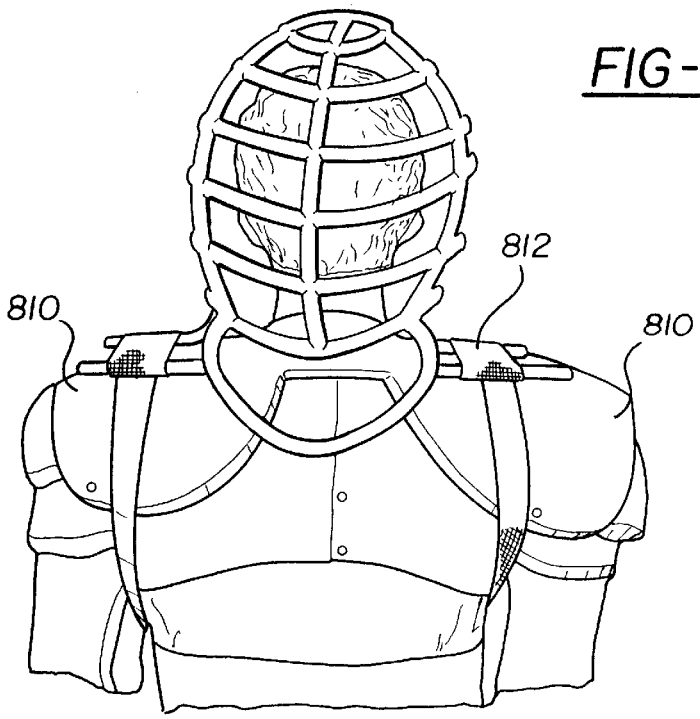
FIG. 36B is rear view of the head case assembly of FIG. 35B shown worn by a football player.
Figure 37A:
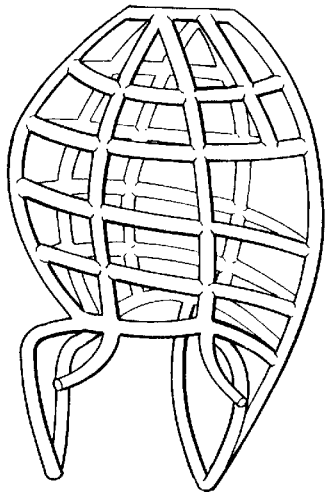
FIG. 37A is a side view of the shoulder pad mounted protective head cage assembly shown in FIG. 35A.
Figure 37B:
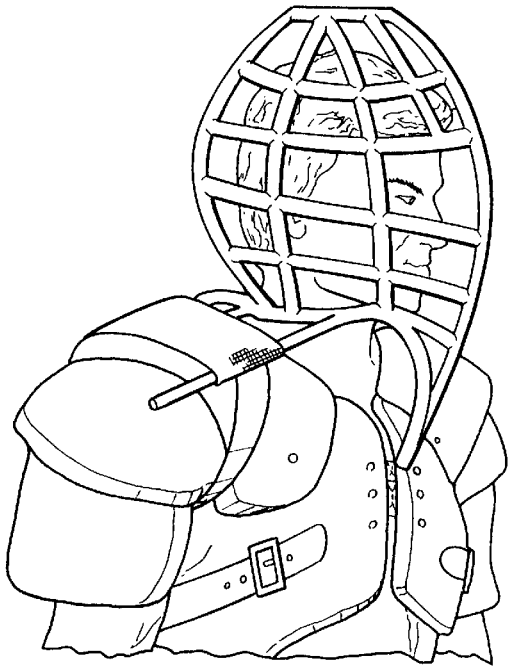
FIG. 37B is side view of the head case assembly of FIG. 35B shown worn by a football player.
Figure 38A:
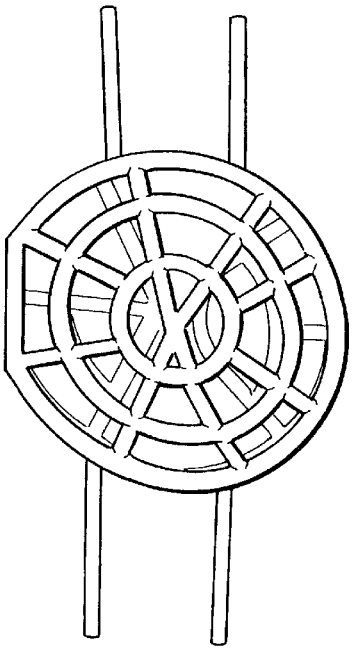
FIG. 38A is a top view of the shoulder pad mounted protective head cage assembly shown in FIG. 35A.
Figure 38B:
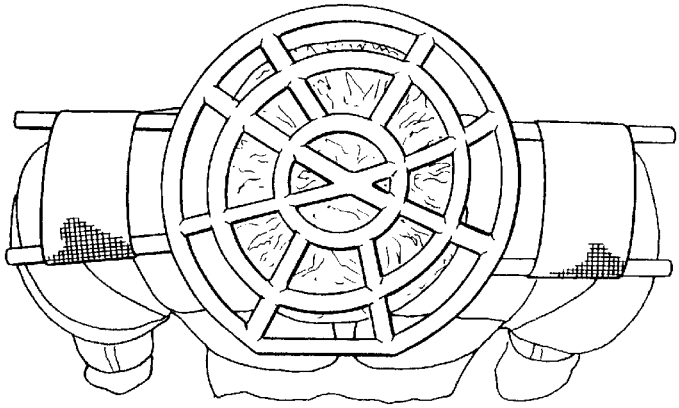
FIG. 38B is top view of the head case assembly of FIG. 35B shown worn by a football player.

A sixth alternate construction for a shoulder pad mounted protective head cage assembly 700 is shown in FIGS. 32, 33 and 34. A unique feature of this construction is the use of the compression formed foam within the shock absorbing horizontal springs 250 to assist in control of the vertical shock absorbing characteristics, especially in the higher weight range of over 200 pounds of persons wearing the protective head cage assembly. Eight elliptical shaped springs 250 as shown in FIG. 19 are equally spaced circumferential, as shown in FIG. 18, to nest in recesses in the top of the compression formed composite plastic ring 720 at the top of the lower support structure and in symmetrically opposite recesses in the compression formed composite plastic ring 710 at the bottom of the crown structure. The springs 250 are preferably constructed of spring steel round wire and heat treated to a Rockwell hardness of 40 and nickel plated.

The crown structure assembly 702 comprises a compression fiberglass/graphite random fiber composite plastic oblong oval ring 710 with a formed perimeter flange that depends in a horizontal spaced relation to the top of the lower support structure 704 when the two structures are joined together. Inside the vertical flange are the eight equally space apart recesses for the elliptical shaped springs 250 with the recesses only as deep as the thickness of the spring steel round wire and are shaped horizontal to the radius of the ellipse. There is a recess around the top inner surface for mounting the crown piece. The crown piece is of fiberglass/graphite random fiber composite plastic compression formed into an oblong oval hemisphere, with a NIDACORE plastic panel compression formed to fit in surface-to-surface contact on the inside and with a second fiberglass/graphite random fiber composite plastic panel to fit outside the NIDACORE plastic panel. The three panels are adhesively bonded under pressure to each other and to the compression formed composite plastic ring 710. The lower support structure 704 has a compression formed fiberglass/graphite random fiber composite plastic ring 720 that fits inside the flange of the crown structure 702 and is the same oblong oval shape. Recesses in the top surface that are symmetrically opposite to those in the bottom of the crown composite plastic ring 710. From about midway on the sides and around the front bottom surface is a recess for a dual panel face shield 780 and around the back a recess for a sandwich vertical panel 760. At the bottom of the lower support structure is a fiberglass/graphite random fiber composite plastic ring 722 compression formed for the bottom surface to conform to the surface of the shoulder pad across the front, arcuately upward over the shoulder areas and arcuately downward across the upper portion of the back. From the apex of the shoulder area on each side and around the front is a vertical portion that extends from the bottom surface to a point about midway between the bottom and a horizontal plane at the apex of the arched shoulder area, with a recess on the outside surface of this vertical portion, for mounting the face shield 780. There is a thick pad area on the inside above the apex of the shoulder areas for mounting a horizontal adjusting plate. Thickened areas are defined at the center bottom of the front and back for attaching the metal plates 66 and 67 for mounting a front latching means and a back hinge means, respectively.

A recess extends from the recess for the face shield 780 on each side on the outside top surface, around the back for mounting a sandwich vertical panel 760. In the front vertical portion on each side is a rectangular opening 782 that has a liquid tight sliding cover on the inside. The vertical sandwich panel is preferably constructed of fiberglass/graphite unidirection fiber composite plastic with a NIDACORE panel in the center. The unidirection of the composite plastic is vertical. The panel is compression formed to match the outer surfaces of the composite plastic rings at the bottom and top of the lower support structure. The sandwich vertical panel extends from the top of the recess in the bottom composite plastic ring at the bottom to the top of the recess in the bottom of the composite plastic ring at the top, and from about midway on one side to a similar point on the opposite side, and has recesses in the outside vertical surfaces at the front. At the back on each side are openings 782 similar to those in the front with liquid tight sliding covers on the inside.

In some applications it may be desirable to have an opening in the back of the vertical panel, specifically for the attaching of an adapter for a portable oxygen tank. The sandwich vertical panel is adhesive and pressure bonded to the composite plastic rings at the bottom and top of the lower support structure 704. A dual panel thermoformed or injection molded transparent polycarbonate face shield 780 of compound curvature shape, with the perimeter surface sized to fit in surface-to-surface contact with the surfaces of the recesses in the lower support structure is attached to that structure with a liquid tight gasket in between with truss head machine screws and T-nuts. A laminate of two different densities of closed cell foam are compression formed separately into oblong oval rings and then bonded together to form the energy absorbing annular band 770. The higher density foam of a shore durometer of 50 to 60 fills the area horizontally between the vertical flange on the perimeter at the bottom of the crown structure and the inside surface and vertically between the top surface of the recess in the top of the composite plastic ring 720 at the top of the lower support structure and the bottom of the recess in the bottom of the crown structure 702 and is configured to fill the area within the elliptical springs and between the ends of the elliptical springs. The lower density closed cell foam of a shore durometer of 30 to 40 is in cross section about three times as high as thick horizontal is compression formed to have a flat outer surface and a convex inner surface to which is bonded a fabric under the trade name ETC. The lower density compression formed piece is made into an oblong oval to fit on the inside of the higher density foam oblong oval.

At time of final assembly, the elliptical springs are positioned on the inside of the high density foam oblong oval ring and a pliable adhesive applied to the top surface of the recess in the top of the composite plastic ring at the top of the lower support structure and to the bottom surface of the high density foam oblong ring with this oblong ring now being positioned with the elliptical springs in their respective recesses in the composite plastic ring at the top of the lower structure. In a similar manner, a pliable adhesive is applied to the top surface of the high density foam oblong ring and elliptical springs and to the surface of the recess in the bottom surface of the composite plastic crown and the crown structure is lowered into position so that the elliptical springs will nest in their respective recesses. Once the adhesive has cured, the lower density oblong ring is adhesively bonded to the inside surface of the high density oblong ring.

The front latching means and back hinge means are next attached to their respective mounting pads and the proper horizontal positioning means are installed to complete the assembly of the shoulder pad mounted head cage 700.

A seventh alternative embodiment of a head cage assembly 800 is shown in FIGS. 35A–38B. This embodiment comprises a cage 802 preferably constructed as a one-piece, rigid unit that surrounds the head and flows over the shoulders so that the portions that extend over the shoulders may be secured to shoulder pads. The cage preferably is constructed of a high impact material. The front 804 of the cage 802 has an appendage 805 that flows over the upper scapula (shoulder blade) region 806. Each region 806 of the cage 802 may be padded to rest on the corresponding area of the shoulder pads.

The cage 802 is preferably constructed such that a sufficient clearance between the wearer's head and the interior of the cage 802. Thus the user's head is freely movable with the cage and cannot touch the inside of the cage. Padding (not shown) may be added to the inside of the cage where potential contact with the head may occur (whiplash, etc.) on severe impact. The protective cage is formed as a network of interconnected bars may be formed of plastic or metal rod encased in plastic. The design of the cage frame or bars (spacing and size) may be adapted to the sport.

The cage 802 comprises shoulder pad support portions including four legs 808 or extensions that originate from the cage area. Two legs, one right and one left, extend outward from the chin area of the cage and rest on the forward facing part of the should pads. Two legs extend from behind the ear outward and rest on the rear portion of the shoulder pads 810. Each forward and rear leg is connected by an adjustable, heavy, nylon web strap 812, 4 to 6 inches wide that rests on top of the shoulder pads 810. An additional set of securing straps 814 is affixed to the rear leg of each side to secure the cage 802 under the arms to the front leg on each corresponding side. Since no area of the head or neck is touched by the cage, all the impact is taken by the shoulder pads, thus protecting the cervico-spinal area.

Figure 39:
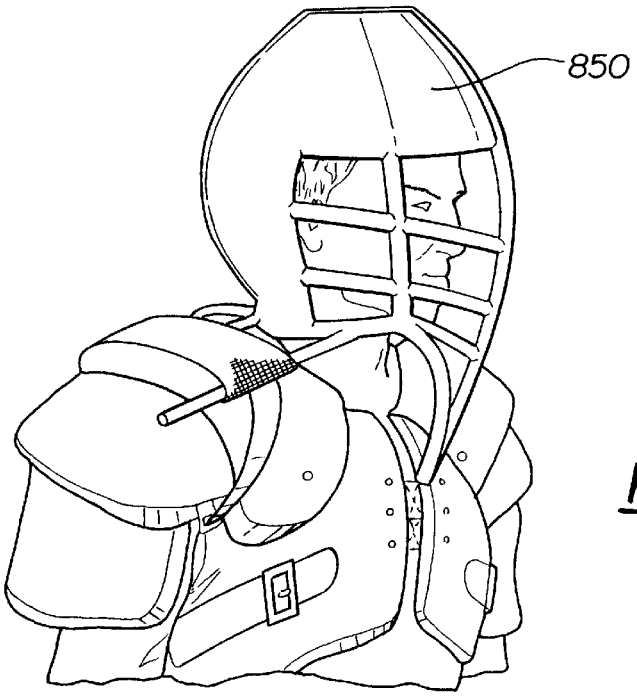
FIG. 39 is a front perspective view of an eighth embodiment of a shoulder pad mounted protective head cage assembly shown worn by a football player.
Figure 40:
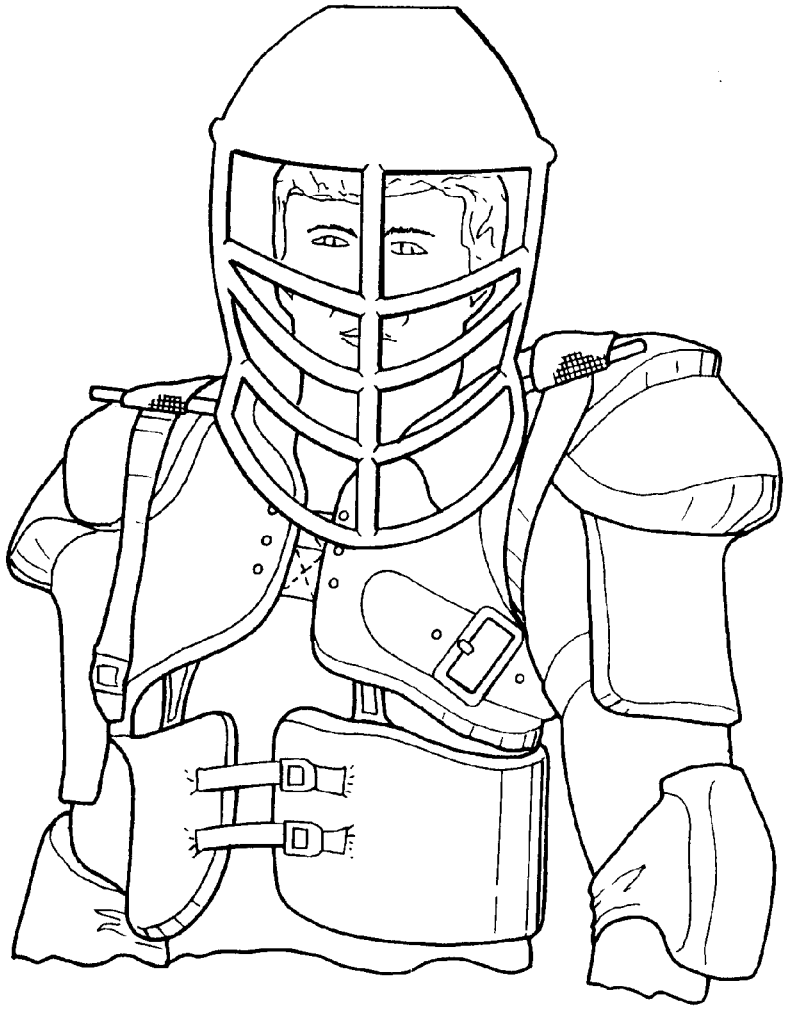
FIG. 40 is a front rear view of the shoulder pad mounted protective head cage assembly shown is FIG. 39.

An eighth alternative embodiment is shown in FIGS. 39 and 40. This embodiment is constructed in accordance with the seventh embodiment and includes a fiberglass or plastic shell 850 fitted to the outside of the cage 802 in the form of an abbreviated helmet to prevent thin objects from entering the head area. The shell provides a platform for the team logo and colors. However, care should be taken so as not to obstruct the vision in any direction since the head turns inside the fixed cage enclose.

Having disclosed my invention, various additional embodiment and improvements that do not depart from the scope of the present invention will be obvious to those having skill in the art.

What is claimed is:

1. A head and neck protection apparatus comprising:

a first and a second shoulder pad forming a pair of shoulder pads;

a helmet, said helmet adapted for surrounding and being spaced apart from a user's head and neck comprising:

a first sub-assembly removably mounted to said shoulder pads;

a second sub-assembly resiliently mounted to said first sub-assembly;

a mount for resiliently connecting said second sub-assembly to said first sub-assembly.

2. The head and neck protection apparatus as set forth in claim 1 wherein said mount comprises at least two springs.

3. The head and neck protection apparatus as set forth in claim 1 wherein said mount comprises closed cell foam pad.

4. The head and neck protection apparatus as set forth in claim 3 wherein said closed cell foam pad comprises a pad of at least two cell densities.

5. The head and neck protection apparatus as set forth in claim 1 wherein said helmet further comprises an impact absorbing annular band disposed on an interior surface of said helmet.

6. The head and neck protection apparatus as set forth in claim 5 wherein said annular band comprises a closed-cell foam pad.

7. The head and neck protection apparatus as set forth in claim 6 wherein said annular band comprises an inflatable annular ring.

8. The head and neck protection apparatus as set forth in claim 1 wherein said helmet is constructed of fiberglass.

9. The head and neck protection apparatus as set forth in claim 1 wherein said helmet comprises a cage.

10. The head and neck protection apparatus as set forth in claim 9 wherein said cage further comprises a fiberglass cover.

11. The head and neck protection apparatus as set forth in claim 1 wherein said helmet comprises at least one pad for adjusting said helmet on said shoulder pads.

12. The head and neck protection apparatus as set forth in claim 1 wherein said helmet is constructed of a polycarbonate material.

13. A head and neck protection apparatus comprising:

a first and a second shoulder pad forming a pair of shoulder pads, said first shoulder pad having a first strap and said second shoulder pad having a second shoulder strap;

a cage, said cage adapted for surrounding and being spaced apart from a user's head and neck, said cage having a first and a second pair of legs extending outwardly from said cage supporting said cage on said shoulder pads, said legs being removably secured on said shoulder pads by said first and second straps.

* * * * *